US009395056B2

(12) United States Patent
Dixon et al.

(10) Patent No.: US 9,395,056 B2
(45) Date of Patent: Jul. 19, 2016

(54) SUSPENDED LINEAR FIXTURE

(71) Applicant: CREE, INC., Durham, NC (US)

(72) Inventors: Mark Edward Dixon, Morrisville, NC (US); Randy Bernard, Cary, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/842,150

(22) Filed: Mar. 15, 2013

(65) Prior Publication Data

US 2014/0126190 A1 May 8, 2014

Related U.S. Application Data

(63) Continuation of application No. 13/782,820, filed on Mar. 1, 2013, which is a continuation-in-part of application No. 13/672,592, filed on Nov. 8, 2012.

(51) Int. Cl.

| | |
|---|---|
| ***F21L 4/00*** | (2006.01) |
| ***F21V 7/00*** | (2006.01) |
| ***F21V 21/00*** | (2006.01) |
| ***F21K 99/00*** | (2016.01) |
| ***F21S 8/06*** | (2006.01) |
| ***F21V 21/112*** | (2006.01) |
| *F21Y 103/00* | (2016.01) |

(52) U.S. Cl.

CPC ... *F21L 4/00* (2013.01); *F21K 9/30* (2013.01); *F21S 8/063* (2013.01); *F21V 7/00* (2013.01); *F21V 21/00* (2013.01); *F21V 21/112* (2013.01); *F21Y 2103/003* (2013.01)

(58) Field of Classification Search

CPC ..... F21L 4/00; F21K 9/30

USPC ..... 362/190, 217.05, 217.04; 313/497

See application file for complete search history.

(56) References Cited

U.S. PATENT DOCUMENTS

| | | | | |
|---|---|---|---|---|
| 4,118,763 | A | 10/1978 | Osteen | 359/833 |
| 4,300,185 | A | 11/1981 | Wakamatsu | 362/147 |
| 4,464,707 | A | 8/1984 | Forrest | 362/271.06 |
| 4,472,767 | A | 9/1984 | Wenman | 362/147 |
| 4,946,547 | A | 8/1990 | Palmour et al. | |
| 5,200,022 | A | 4/1993 | Kong et al. | |
| RE34,861 | E | 2/1995 | Davis et al. | |

(Continued)

FOREIGN PATENT DOCUMENTS

| | | | |
|---|---|---|---|
| DE | WO2008003289 | 1/2008 | F21S 4/003 |

OTHER PUBLICATIONS

CircalokTM conductive adhesive. 6972 and 6968, by Lord Corporation, 2 pages.

U.S. Appl. No. 13/649,052, filed Oct. 10, 2012, Lowes, et al.

U.S. Appl. No. 13/649,067, filed Oct. 10, 2012, Lowes, et al.

U.S. Appl. No. 13/770,389, filed Feb. 19, 2013, Lowes, et al.

(Continued)

*Primary Examiner* — Anne Hines

(74) *Attorney, Agent, or Firm* — Koppel, Patrick, Heybl & Philpott

(57) ABSTRACT

This disclosure relates to suspended linear lighting fixtures that are arranged to accept lighting elements. Lighting fixtures according to the present disclosure comprise at least one body and at least one suspension mechanism. These lighting fixtures can be arranged such that electrical and mechanical connections can be provided at various locations along their length, rather than only at the distal ends of the fixtures. The fixtures can also comprise various connectivity features that allow further arrangements, designs and spatial adjustments. Lighting systems utilizing these fixtures are also disclosed.

38 Claims, 13 Drawing Sheets

(56) References Cited

U.S. PATENT DOCUMENTS

| | | | | |
|---|---|---|---|---|
| 5,530,628 | A | 6/1996 | Ngai | 362/127 |
| 5,690,415 | A | 11/1997 | Krehl | 362/125 |
| 5,823,663 | A | 10/1998 | Bell et al. | |
| 5,951,150 | A | 9/1999 | Helstern | 362/293 |
| 6,210,025 | B1 | 4/2001 | Schmidt et al. | |
| 6,435,697 | B1 | 8/2002 | Simmons | 362/219 |
| 6,536,924 | B2 | 3/2003 | Segretto | 362/345 |
| 6,667,451 | B1 | 12/2003 | Hart | 200/314 |
| 6,739,734 | B1 | 5/2004 | Hulgan | 362/243 |
| 6,914,194 | B2 | 7/2005 | Fan | |
| 7,131,747 | B1 | 11/2006 | Yates | 362/219 |
| 7,213,940 | B1 | 5/2007 | Van de Ven et al. | |
| 7,217,023 | B2 | 5/2007 | Iwasa et al. | 362/555 |
| 7,228,253 | B2 | 6/2007 | Chen | 318/11 |
| 7,387,410 | B2 | 6/2008 | Sibout | 362/375 |
| 7,540,627 | B2 | 6/2009 | Handsaker | 362/225 |
| 7,628,506 | B2 | 12/2009 | Verfuerth et al. | 362/218 |
| 7,654,703 | B2 | 2/2010 | Kan et al. | 362/362 |
| 7,722,220 | B2 | 5/2010 | Van De Ven et al. | |
| 7,758,207 | B1 | 7/2010 | Zhou | 362/217.1 |
| 7,791,061 | B2 | 9/2010 | Edmond et al. | |
| 8,058,088 | B2 | 11/2011 | Cannon et al. | |
| 8,206,004 | B2 | 6/2012 | Serak et al. | 362/217 |
| 8,220,953 | B1 | 7/2012 | Moore | 362/217.01 |
| 8,313,212 | B1 | 11/2012 | Mayer et al. | 362/219 |
| 8,317,369 | B2 | 11/2012 | McCanless | 362/368 |
| 8,342,714 | B1 | 1/2013 | Rea | 362/264 |
| 8,376,578 | B2 | 2/2013 | Kong, II | 362/241 |
| 8,459,824 | B1 | 6/2013 | Esmailzadeh et al. | 362/147 |
| 8,523,383 | B1 | 9/2013 | Grigore et al. | 362/221 |
| 8,714,770 | B2 | 5/2014 | Kato | 362/227.06 |
| 8,764,220 | B2 | 7/2014 | Chan et al. | 362/217.02 |
| 9,057,493 | B2 | 6/2015 | Silmon | |
| 2001/0048599 | A1 | 12/2001 | Hess | 362/290 |
| 2004/0240214 | A1 | 12/2004 | Whitlow et al. | 362/373 |
| 2004/0252521 | A1 | 12/2004 | Clark | 362/554 |
| 2005/0041418 | A1 | 2/2005 | Fan | 362/217.05 |
| 2005/0146867 | A1* | 7/2005 | Kassay et al. | 362/217 |
| 2006/0050505 | A1 | 3/2006 | McCarthy | 362/219 |
| 2006/0266955 | A1 | 11/2006 | Arvin | 250/492.1 |
| 2006/0278882 | A1 | 12/2006 | Leung | 257/98 |
| 2007/0158668 | A1 | 7/2007 | Tarsa et al. | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0258130 | A1 | 10/2008 | Bergmann et al. | |
| 2008/0285267 | A1 | 11/2008 | Santoro | 362/224 |
| 2008/0314944 | A1 | 12/2008 | Tsai | 224/331 |
| 2009/0040782 | A1 | 2/2009 | Liu et al. | 362/555 |
| 2009/0046457 | A1 | 2/2009 | Everhart | 362/235 |
| 2009/0161356 | A1* | 6/2009 | Negley et al. | 362/231 |
| 2009/0184333 | A1 | 7/2009 | Wang et al. | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0290345 | A1 | 11/2009 | Shaner | 362/249.01 |
| 2009/0290348 | A1 | 11/2009 | Van Laanen et al. | 362/249 |
| 2009/0296381 | A1 | 12/2009 | Dubord | 362/218 |
| 2010/0002426 | A1 | 1/2010 | Wu | 362/223 |
| 2010/0110701 | A1 | 5/2010 | Liu | 362/373 |
| 2010/0128485 | A1 | 5/2010 | Teng | 362/294 |
| 2010/0142205 | A1 | 6/2010 | Bishop | 362/249.02 |
| 2010/0155763 | A1 | 6/2010 | Donofrio et al. | |
| 2010/0171404 | A1 | 7/2010 | Liu et al. | 313/46 |
| 2010/0214770 | A1 | 8/2010 | Anderson | 362/133 |
| 2010/0214785 | A1 | 8/2010 | Chen | 362/267 |
| 2010/0220469 | A1 | 9/2010 | Ivey et al. | 362/218 |
| 2010/0259927 | A1 | 10/2010 | Chien | 362/235 |
| 2010/0328945 | A1 | 12/2010 | Song et al. | 362/240 |
| 2011/0006688 | A1 | 1/2011 | Shim | 315/119 |
| 2011/0007514 | A1 | 1/2011 | Sloan | 362/368 |
| 2011/0013400 | A1 | 1/2011 | Kanno et al. | |
| 2011/0028006 | A1 | 2/2011 | Shah et al. | 439/39 |
| 2011/0090682 | A1 | 4/2011 | Zheng | 362/218 |
| 2011/0103043 | A1 | 5/2011 | Ago | 362/147 |
| 2011/0163683 | A1 | 7/2011 | Steele et al. | 315/192 |
| 2011/0211330 | A1* | 9/2011 | Wang | 362/20 |
| 2011/0285314 | A1 | 11/2011 | Carney et al. | 315/294 |
| 2011/0286207 | A1 | 11/2011 | Chan et al. | 362/217.1 |
| 2011/0286208 | A1 | 11/2011 | Chen | 362/217.1 |
| 2011/0310604 | A1 | 12/2011 | Shimizu | 362/235 |
| 2011/0310614 | A1 | 12/2011 | Budike, Jr. | 362/294 |
| 2012/0002408 | A1* | 1/2012 | Lichten et al. | 362/218 |
| 2012/0051041 | A1 | 3/2012 | Edmond | 362/231 |
| 2012/0075857 | A1 | 3/2012 | Verbrugh | 362/249 |
| 2012/0081883 | A1 | 4/2012 | Wang | 362/101 |
| 2012/0098424 | A1 | 4/2012 | Arik | 315/35 |
| 2012/0120666 | A1 | 5/2012 | Moeller | 362/308 |
| 2012/0169234 | A1 | 7/2012 | Shew | 315/88 |
| 2012/0182755 | A1 | 7/2012 | Wildner | 362/555 |
| 2012/0218757 | A1 | 8/2012 | Gill | 362/235 |
| 2012/0235199 | A1 | 9/2012 | Andrews et al. | |
| 2012/0250302 | A1 | 10/2012 | Edwards | 362/223 |
| 2013/0039090 | A1 | 2/2013 | Dau | 362/551 |
| 2013/0050998 | A1 | 2/2013 | Chu et al. | 362/218 |
| 2013/0094225 | A1 | 4/2013 | Leichner | 362/368 |
| 2013/0155670 | A1 | 6/2013 | Handsaker | 362/223 |
| 2013/0258616 | A1 | 10/2013 | Chao | 361/752 |
| 2013/0271979 | A1 | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2014/0085861 | A1 | 3/2014 | Nicolai | 362/84 |
| 2014/0265809 | A1 | 9/2014 | Hussell | |
| 2015/0016100 | A1 | 1/2015 | Ishii | 362/223 |

OTHER PUBLICATIONS

U.S. Appl. No. 13/782,820, filed Mar. 1, 2013, Dixon, et al.
U.S. Appl. No. 12/873,303, filed Aug. 31, 2010, Edmond, et al.
Restriction Requirement from U.S. Appl. No. 13/839,130. dated Jul. 28, 2014.
Office Action from U.S. Appl. No. 13/839,130, dated Sep. 25, 2014.
Office Action from U.S. Appl. No. 29/449,316. dated Jun. 5, 2014.
Leviton LED Magnetic Tube Retrofit Series datasheet, 1 page. from www.leviton.com.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763.270, dated May 19, 2015.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/829,558, dated Sep. 11, 2015.
Office Action from U.S. Appl. No. 14/252,685, dated Oct. 1, 2015.
Office Action from U.S. Appl. No. 13/956,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
Office Action from U.S. Appl. No. 13/910,486; Mar. 1, 2016.
Office Action from U.S. Appl. No. 14/108,168; May 20, 2016.
Office Action from U.S. Appl. No. 14/252,685; May 20, 2016.
Office Action from U.S. Appl. No. 14/108,168; Dec. 24, 2015.
Office Action from U.S. Appl. No. 13/763,270; Jan. 12, 2016.
Office Action from U.S. Appl. No. 13/899,314; Feb. 4, 2016.
Office Action from U.S. Appl. No. 14/070,098; Feb. 5, 2016.
Office Action from U.S. Appl. No. 13/829,558; Feb. 19, 2016.

* cited by examiner

FIG. 3
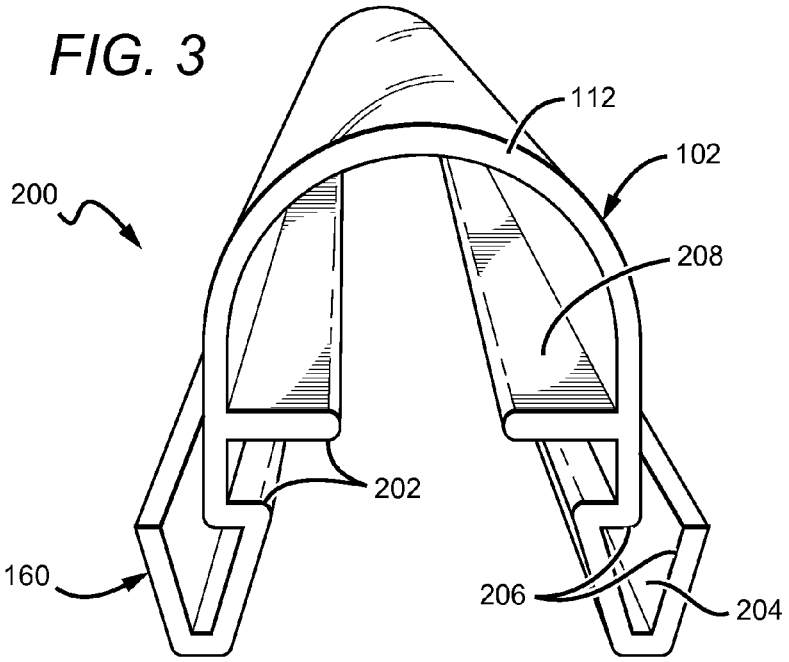
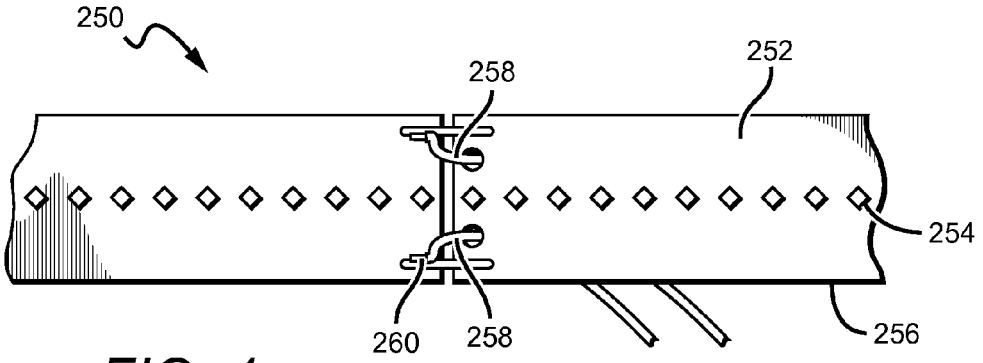
FIG. 4
FIG. 5
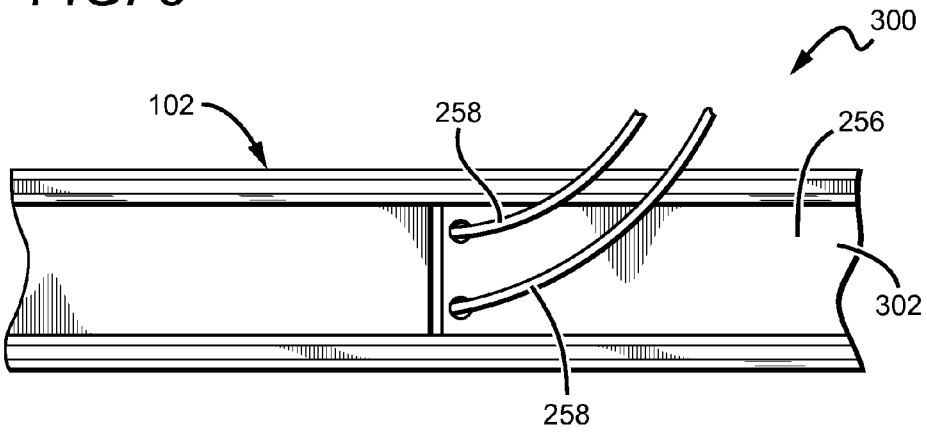

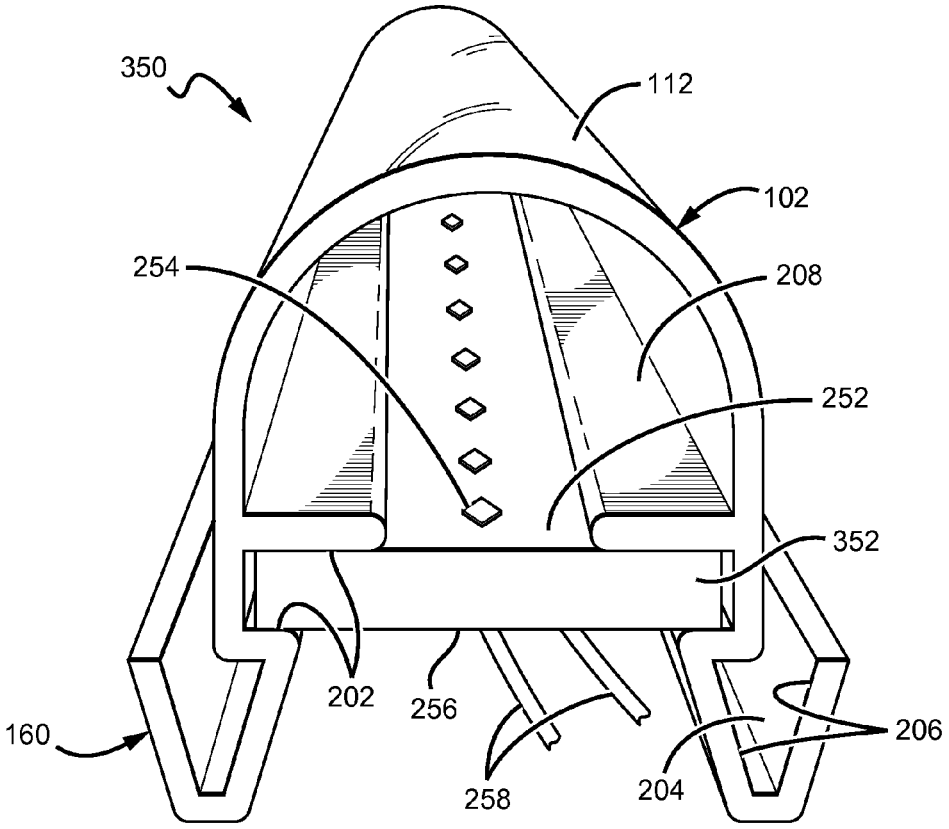
FIG. 6
FIG. 7
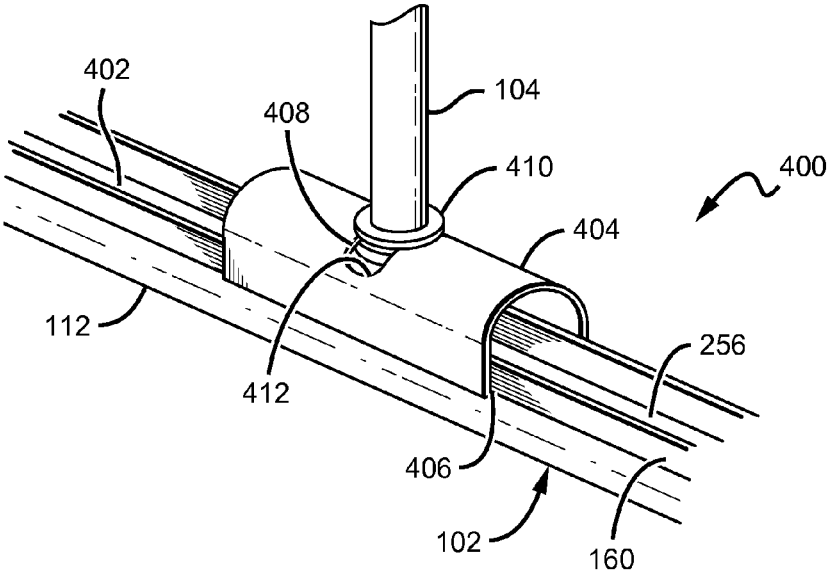

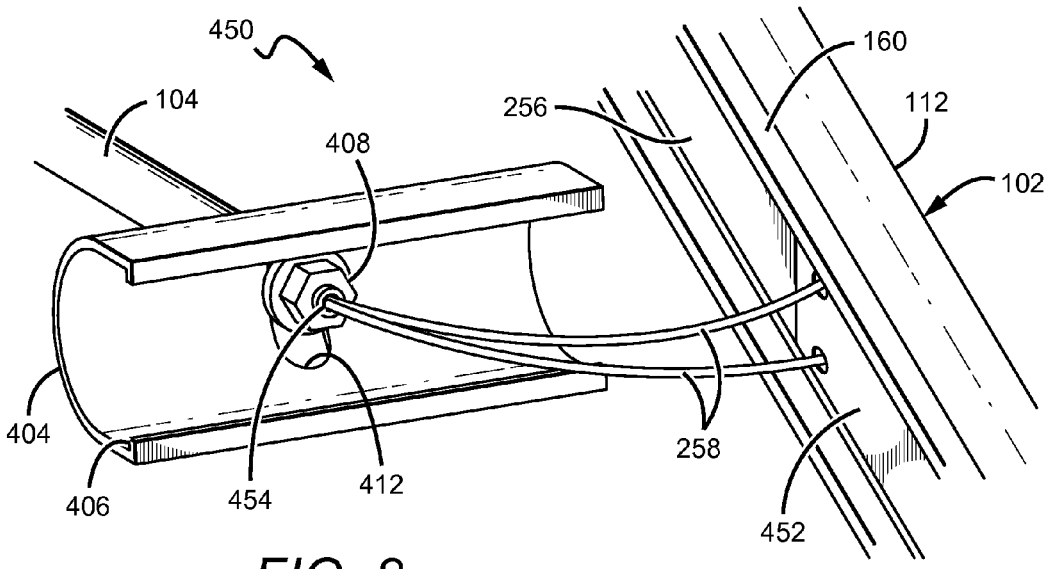
FIG. 8
FIG. 9
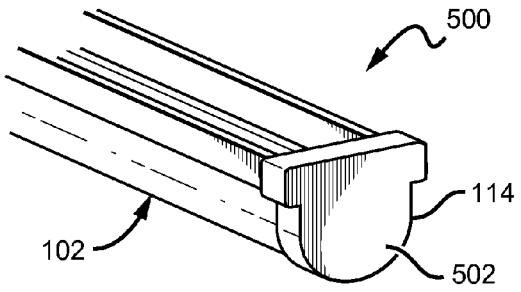
FIG. 10
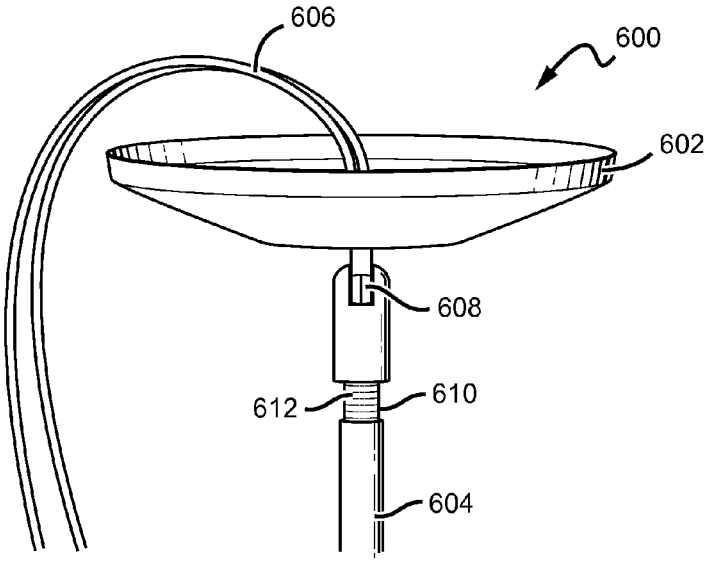

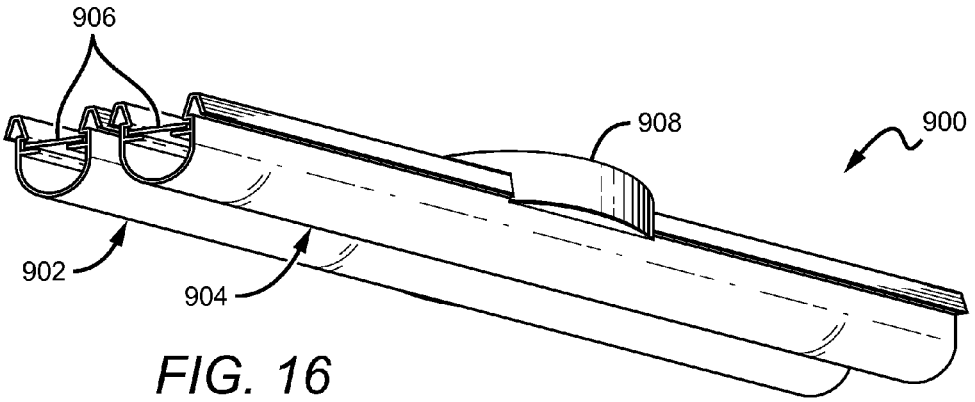
FIG. 16
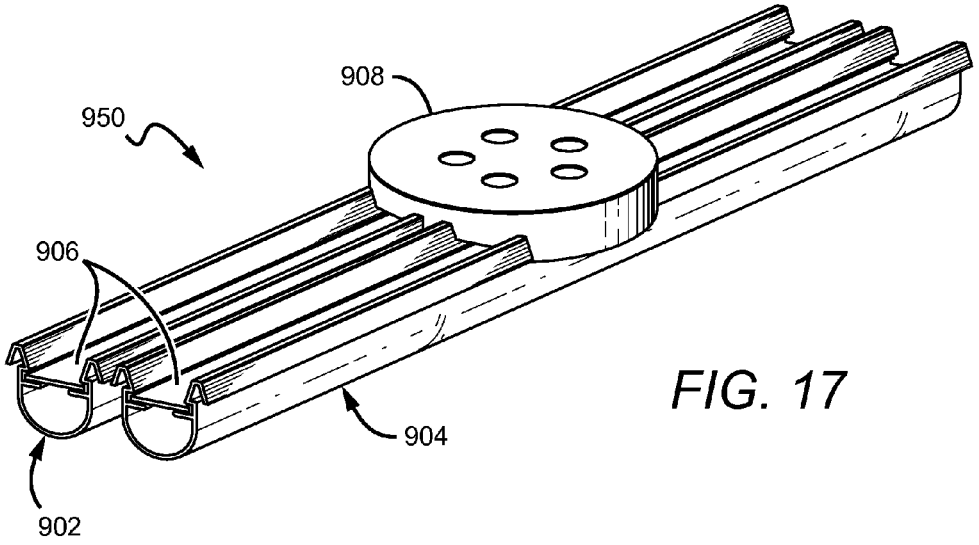
FIG. 17
FIG. 18
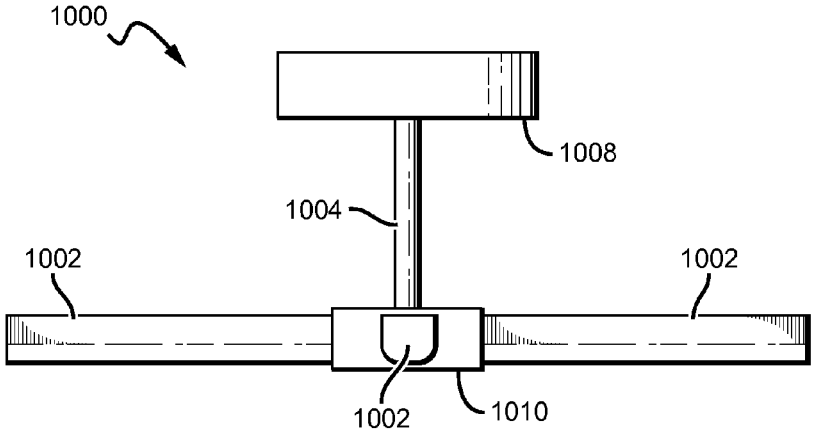

FIG. 25
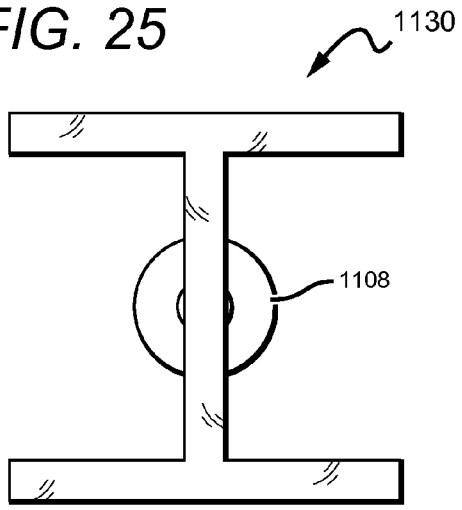
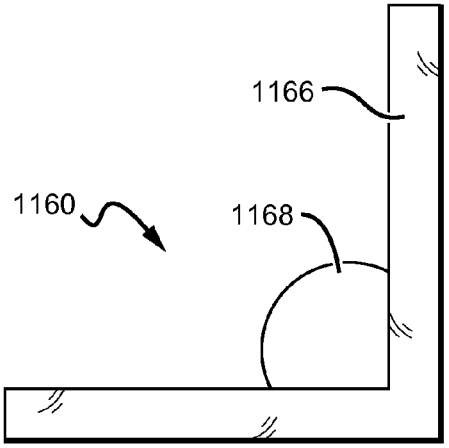
FIG. 27
FIG. 26
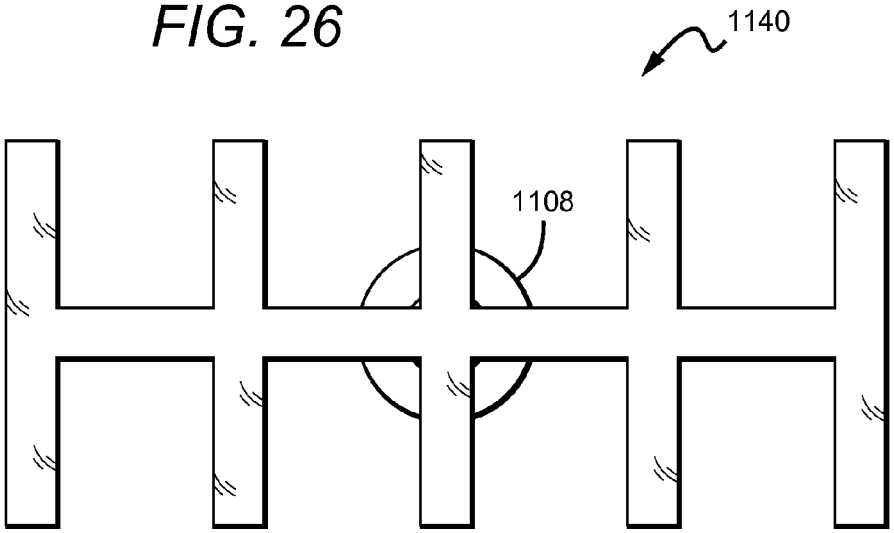

FIG. 28
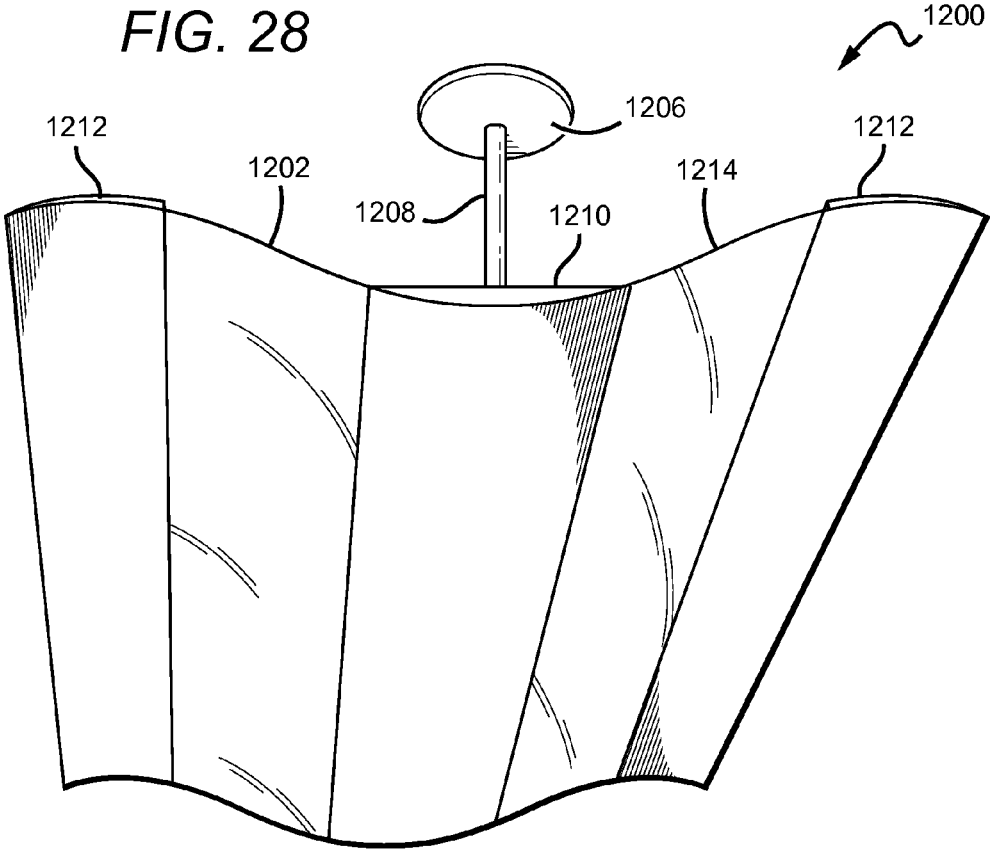
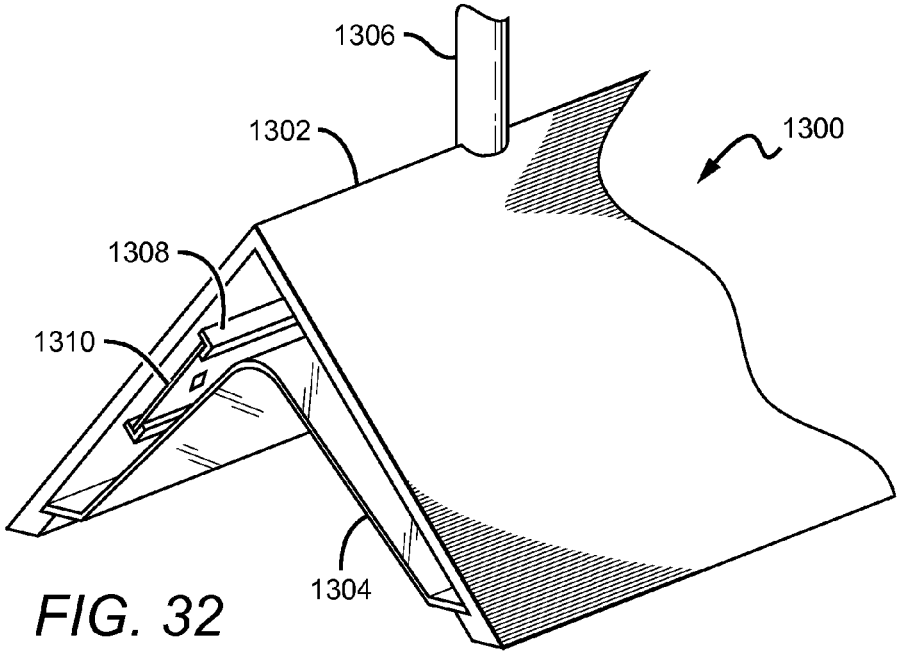
FIG. 32

FIG. 29
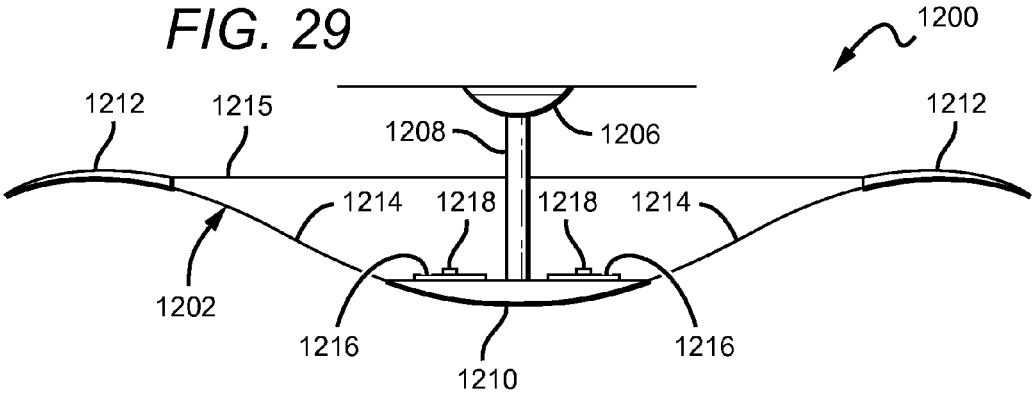
FIG. 30
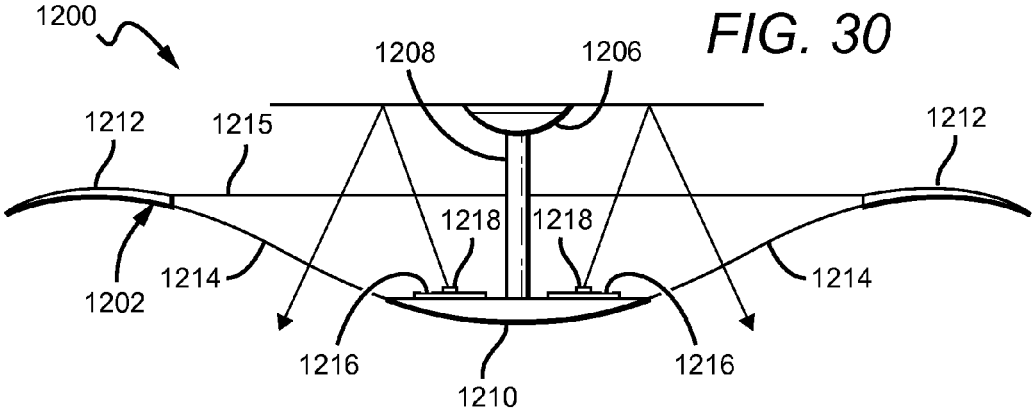
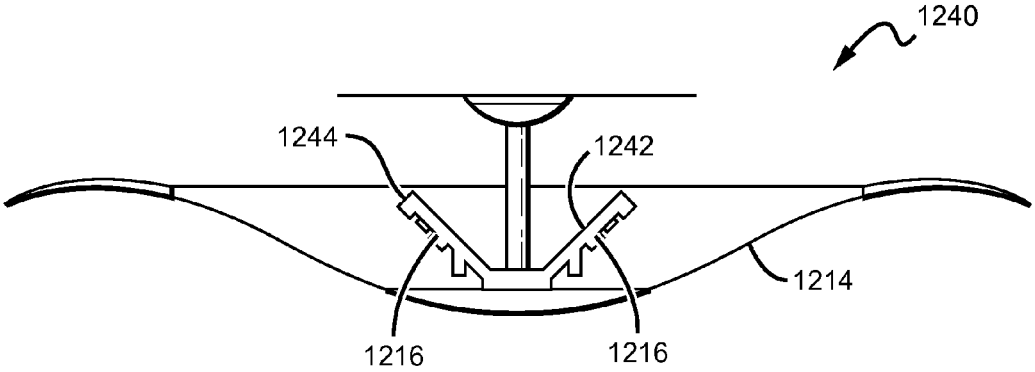
FIG. 31

SUSPENDED LINEAR FIXTURE

CROSS REFERENCE TO RELATED APPLICATIONS

This application is a continuing application of, and claims the benefit of, U.S. patent application Ser. No. 13/782,820, to Mark Dixon, et al. entitled Integrated Linear Light Engine, filed on Mar. 1, 2013, which is a continuation in part of and claims the benefit of U.S. patent application Ser. No. 13/672,592 to Mark Dixon, entitled Recessed Light Fixture Retrofit Kit, filed on Nov. 8, 2012, both of these applications are hereby incorporated herein in their entirety by reference, including the drawings, charts, schematics, diagrams and related written description.

BACKGROUND OF THE INVENTION

1. Field of the Invention

Described herein are devices relating to lighting fixtures, such as suspended linear lighting fixtures, that are well suited for use with solid state lighting sources, such as light emitting diodes (LEDs).

2. Description of the Related Art

Lighting fixtures, such as Troffer-style lighting fixtures, are ubiquitous in commercial office and industrial spaces throughout the world, oftentimes being designed to have a spatially convenient and aesthetically pleasing linear appearance. To this end, many of these lighting fixtures house linear elongated fluorescent light bulbs that span the length of the troffer. These lighting fixtures can be mounted to or suspended from ceilings, and can be at least partially recessed into the ceiling, with the back side of the troffer protruding into the plenum area above the ceiling. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, troffers and other commercial lighting fixtures have been developed that utilize LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications, such as troffers, that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications, including commercial lighting fixtures. An increase in the adoption of LEDs in place of incandescent or fluorescent lighting would result in increased lighting efficiency and significant energy saving.

LEDs can be arranged in different ways in the above mentioned lighting fixtures, with some fixtures having LEDs incorporated into a linear lighting device and having a structure similar to a florescent tube. These "tube" LED devices can resemble a linear florescent bulb and have electrodes and pins at both ends of their linear structure. Furthermore, suspended fixtures incorporating such linear lighting devices typically hold the lighting devices in place with mechanical support at both ends of their linear structure.

While such lighting fixtures are presently used, these fixtures are limited in how they can be designed and spatially arranged. For example, in the above described linear lighting fixtures, electrical and mechanical connections at both ends of an incorporated lighting device (i.e. a florescent tube, linear LED device, etc.) are typically required. This requirement inhibits freedom of design and arrangement of such fixtures and oftentimes requires the use of bulky additional components such as large troffer bodies. These additional components take up space, provide additional features that are subject to device failure and generally increase the time and cost of manufacturing such devices. Furthermore, these fixtures are usually fixated in a certain structure or arrangement and are not freely adjustable.

SUMMARY OF THE INVENTION

The present invention is generally directed to lighting fixtures, such as linear suspended lighting fixtures, that have increased freedom of design and arrangement. Lighting fixtures according to the present disclosure can have suspension mechanisms and electrical connections provided at various locations along their lengths and do not require physical or electrical connections at their distal ends.

In some embodiments, the lighting fixtures can comprise integrated one or more lighting bodies or light engines that are generally elongated and are suspended such as by a suspension mechanism. The fixtures can include a driver or power supply with electrical circuitry to generate a signal to drive the emitters in the lighting body. In some embodiments, the power supply is arranged separate from the lighting body, such as in a power supply cover at the ceiling where the lighting fixture is mounted. The electrical signal from the power supply can be transmitted to the lighting body in many ways, such as through the suspension mechanism. These embodiments generally comprise a suspended elongated lighting body separate from the driver or power supply.

One embodiment of a lighting fixture according to the present disclosure comprises a body configured to receive a linear lighting element and a suspension mechanism arranged to fix the body in place at least some distance away from a mounting surface. The suspension mechanism can be arranged to provide an electrical connection from the lighting element to a power source, such that the lighting element is unconnected to the power source at one or more distal ends of the lighting element.

Another embodiment of a lighting fixture according to the present disclosure comprises a body configured to receive at least one lighting element and a suspension mechanism arranged to fix the body in place at least some distance away from a mounting surface. The suspension mechanism can be arranged to attach to the body at multiple points on the body, wherein the suspension mechanism is arranged to provide an electrical connection from the lighting element to a power source.

An embodiment of a lighting system according to the present disclosure comprises a body, a linear lighting element attached to the body, a power supply and a suspension mechanism attached to the body. The suspension mechanism can be arranged to fix the body in place at least some distance away from a mounting surface. The suspension mechanism can also be arranged to provide an electrical connection to the lighting element, such that the lighting element is unconnected to said power supply at one or more distal ends of said lighting element.

These and other further features and advantages of the invention would be apparent to those skilled in the art from the following detailed description, taking together with the accompanying drawings, wherein like numerals designate corresponding parts in the figures, in which:

BRIEF DESCRIPTION OF THE DRAWINGS

FIG. 3 is a front perspective view of one embodiment of a lighting fixture according to the present disclosure;

FIG. 4 is a partial top perspective view of one embodiment a lighting element that can be utilized with the present disclosure;

FIG. 5 is a partial top perspective view of one embodiment of a lighting element configuration that can be utilized with the present disclosure;

FIG. 6 is a front perspective view of one embodiment of a lighting fixture according to the present disclosure;

FIG. 7 is partial side perspective view of one embodiment of a lighting fixture according to the present disclosure;

FIG. 8 is a partial unassembled view of one embodiment of a lighting fixture according to the present disclosure;

FIG. 9 is partial side perspective view of one embodiment of a lighting fixture according to the present disclosure;

FIG. 10 is partial side perspective view of one embodiment of a lighting fixture according to the present disclosure;

FIG. 16 is a side perspective view of one embodiment of a lighting fixture according to the present disclosure;

FIG. 17 is a side perspective view of one embodiment of a lighting fixture according to the present disclosure;

FIG. 18 is a side view of another embodiment of a lighting fixture according to the present invention;

FIG. 25 is a bottom view of another embodiment of a lighting fixture according to the present invention;

FIG. 26 is a bottom view of another embodiment of a lighting fixture according to the present invention;

FIG. 27 is a bottom view of another embodiment of a lighting fixture according to the present invention;

FIG. 28 is a bottom perspective view of another embodiment of a lighting fixture according to the present invention;

FIG. 29 is an end view of the lighting fixture shown in FIG. 28;

FIG. 30 is another end view of the lighting fixture shown in FIG. 28;

FIG. 31 is an end view of another embodiment of a lighting fixture according to the present invention;

FIG. 32 is a perspective view of another embodiment of a lighting fixture according to the present invention;

DETAILED DESCRIPTION OF THE INVENTION

Figure 1:
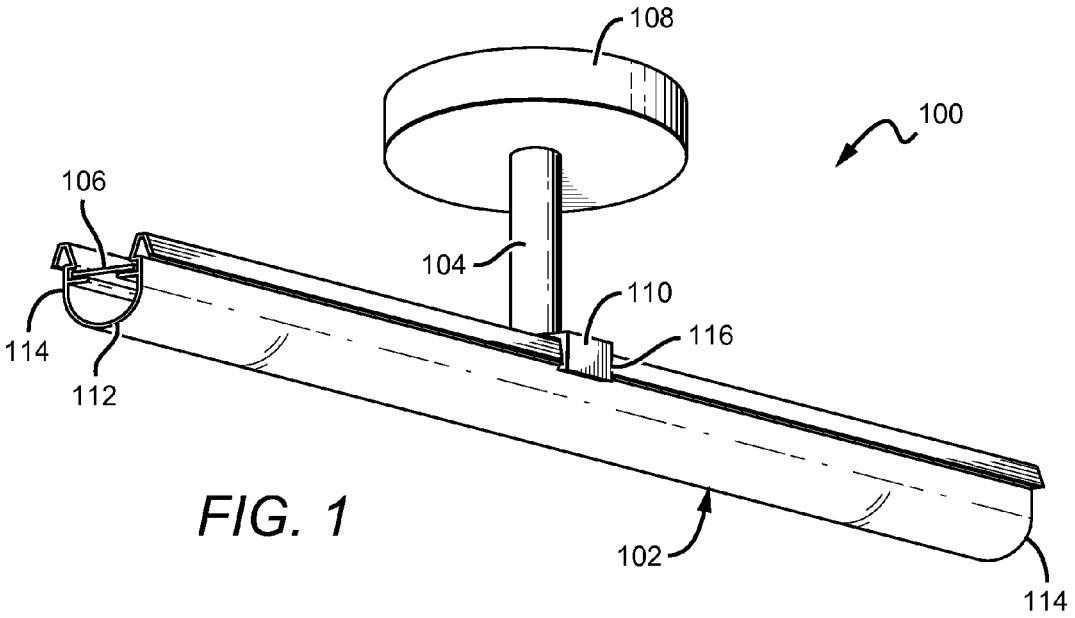
FIG. 1 is a side perspective view of one embodiment of a lighting fixture according to the present disclosure.

The present disclosure is directed to different embodiments of lighting fixtures that allow for increased freedom of design and arrangement of the different light fixture features. Some embodiment can provide increased freedom concerning how their corresponding lighting elements or light engines are electrically and mechanically attached to other structures or arranged in space.

In some embodiments, lighting fixtures according to the present disclosure comprise linear bodies and their corresponding lighting elements are unattached electrically and/or mechanically at their distal ends. One of the features that make this possible is the selection of a lighting element, such as an LED light engine with a PCB, which allows for an electrical connection that can power the lighting element to connect to the lighting element in multiple possible locations.

In some embodiments, lighting fixtures according to the present disclosure can have mechanical suspension mechanisms and/or support structures that can be designed and arranged to be attached to the fixture's body at multiple points on the body rather than only be attached at a particular location, such as at the distal ends. In some embodiments, these suspension mechanisms and mechanical support structures can be adjusted or freely removed and reattached to provide different fixture arrangements. The suspension mechanism can also comprise an element to provide separation between the power supply and linear lighting body. In some embodiments, the power supply can be at the ceiling where the lighting fixture is mounted, with the power supply separated from the lighting body by the suspension mechanism.

In some embodiments, lighting fixtures according to the present disclosure can have various connection configurations, with some being self-connecting or self-coupling. That is, the light engines can be mounted in their operational location in the fixture without the need for mounting mechanisms or bonding materials. One such self-connecting configuration can be a "snap-fit" feature on the light engine or lighting fixture that cooperates with a connection structure on the other of the light engine or lighting fixture. In some embodiments, this connection configuration can allow the lighting engines to be removably mounted in the lighting fixture. Other connection configurations can pivot to allow for the angle or orientation of the lighting fixture to be adjusted, changing its position according to desired lighting requirements.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connect" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes" and/or "including when used herein, specify the presence of stated features, integers, steps, operations, elements, and/or components, but do not preclude the presence or addition of one or more other features, integers, steps, operations, elements, components, and/or groups thereof.

As used herein, the term "lighting element" refers to any structure that can emit light in response to an electrical signal and includes LEDs and LED devices containing one or more LEDs arranged into an array or incorporated into a light engine.

As used herein the term "distal" refers to the terminal ends of a structure furthest from the structure's center or from a point of attachment of another structure. For example, the distal ends of a linear lighting fixture are the terminal ends of the fixture furthest from the point of attachment of a suspension mechanism. The distal ends of a linear lighting element are its terminal ends furthest from the center of the lighting element.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

FIG. 1 is a side perspective view of one embodiment of a lighting fixture 100 according to the present disclosure. Lighting fixture 100 comprises a lighting element body or light engine 102, which can impart a linear shape to the fixture and can be arranged to receive at least one lighting element 106, and at least one suspension mechanism 104, which can fix body 102 spatially in place at least some distance away from a mounting surface, such as a ceiling, floor or wall. Lighting fixture 100 can further comprise a power supply cover 108 which can attach lighting fixture 100 to a mounting surface and conceal a power supply and/or power cord or other electrical connection elements. Suspension mechanism 104 can further comprise an attachment element 110, which serves to attach body 102 to suspension mechanism 104 and can provide additional structural support for lighting fixture 100. All of these named elements will be discussed in further detail below with reference to the additional figures.

Body 102 can be made from any suitable material that can impart a rigid structure but at least a portion of body 102, which is configured to serve as a lens 112, is capable of facilitating the transmittance of light. Body 102 can comprise a variety of materials, including but not limited to metals, plastics, acrylic, polyethylene, various other polymers and/or combinations thereof. In one embodiment, body 102 can be formed from polycarbonate (PC). Body 102 can be formed via a number of processes, including but not limited to extrusion and molding, such as injection molding.

Body 102 can be clear, transparent or translucent such that light emitted from light source 104 can easily pass through body 102. Body 102 can also be diffuse, and in different embodiments can be made diffuse by various means including but not limited to being formed from a diffuse material, being patterned or shaped to have diffuse portions, or by adding materials having diffusing properties, such as diffusing particles. It is understood that the shape, dimensions and orientation of body 102 depicted in the drawings are but some of many the shapes, dimensions and orientation body 102 can take or comprise. Body 102 can comprise a variety of shapes, dimensions and orientations for various purposes, for example, depending on the lighting requirements of various spaces where lighting fixture 100 could be employed. In some embodiments, body 102 has a linear shape with at least one distal end 114 (two shown) which is distal from the point of attachment 116 of suspension mechanism 104 to body 102. Since electrical and mechanical connections can be provided by suspension mechanism 104, it may not be necessary to form such connections at or near the distal ends 114 of body 102, which is typically necessary in contemporary linear fixtures. Since such connections at the distal ends 114 of body 102 are not necessary in fixtures according to the present disclosure, more freedom in the design and installation of such fixtures is achieved.

Suspension mechanism 104, power supply cover 108 and attachment element 110, can be made of the same materials as body 102 or can be made of different materials. Because in many embodiments suspension mechanism 104, power supply cover 108 and attachment element 110, typically do not need to facilitate the transmittance of light, these structures can be more readily made from opaque materials. In some embodiments these elements can comprise heat conductive materials, such as metals, to assist in radiating heat away from the lighting element 106 and dissipate it into the surrounding ambient.

Figure 2:
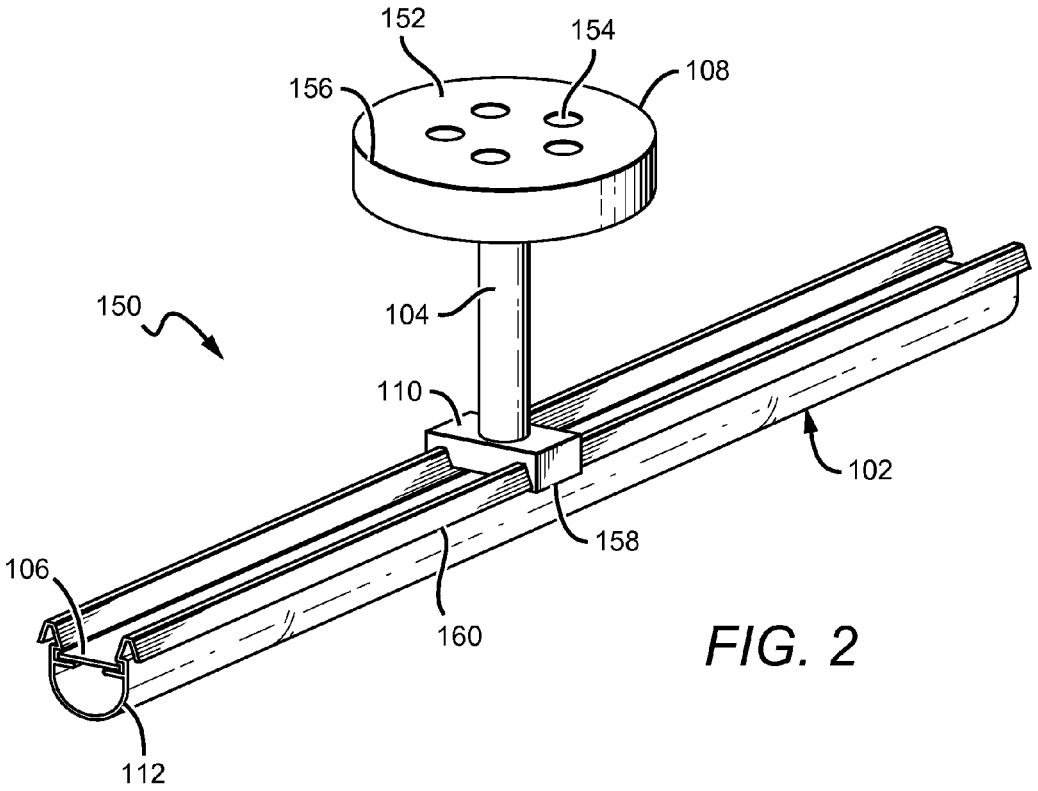
FIG. 2 is side perspective view of one embodiment of a lighting fixture according to the present disclosure.

The top surface of supply cover 108 can also comprise different arrangements. FIG. 2 depicts a different side perspective view of a lighting fixture 150, similar to lighting fixture 100, wherein the corresponding disclosure above is incorporated into this embodiment such that like features share the same reference numbers. Lighting fixture 150 comprises body 102, suspension mechanism 104, power supply cover 108 and attachment element 110. Like lighting fixture 100 in FIG. 1 above, lighting fixture 150 is also configured to receive at least one lighting element 106. FIG. 2 shows the top surface 152 of power supply cover 108. Top surface 152 can be configured to facilitate attachment to a mounting surface using various means known in the art including but not limited to adhesives and mechanical attachments such as screws, hooks and nails.

The top surface 152 of power supply cover 108 can further comprise one or more holes 154. Holes 154 allow outside access to any power supply and/or electrical components internal to power supply cover 108. Alternatively or in addition to the use of holes 154, some or all of the top surface of power supply cover 108 can be missing, providing outside access to internal components. In this latter case, the outer edge 156 of the top surface 152 of power supply cover 108 can be attached to a mounting surface using means known in the art as described above. In some embodiments, power cover 108 is attached to a mounting surface, such as a ceiling, and an internal power supply within power supply cover 108 is put into electrical communication with a junction box within the mounting surface. In other embodiments, electrical connections, for example provided by cords or wires, can be directly established from a lighting element 102 to a junction box within the mounting surface.

FIG. 2 shows another embodiment of a lighting fixture 150, and more clearly shows attachment element 110. Attachment element 110 can provide permanent or temporary attachment between body 102 and suspension mechanism 104. Attachment element 110 can provide this attachment in various ways, for example by providing a complimentary surface to another surface on body 102 and/or suspension mechanism on which to utilize an adhesive or mechanical attachment element.

As mentioned above, the attachment element 110 can be self-coupling or self-connecting to allow for the body 102 to be mounted in its operation location in the light fixture 100 without the need for mounting fixtures such as screws, bolts, brackets, clamps, etc., or the need for bonding materials such as glues. These self-connecting attachment elements can also allow for the body 102 to be removable mounted in the fixture so that is can be removed from the fixture for repair or replacements. In some embodiment, the body 102 can be removed by hand from the fixture 100.

In some embodiments, attachment element 110 comprises one or more attachment element snap-fit structures 158 that allow the body to be snapped into place. The elements in the attachment element 110 can be shaped or configured to interact or mate with one or more corresponding body snap-fit receiving structures 160. The snap-fit attachment can be configured such that it is a strong and rigid attachment that prevents substantial movement of body 102 should body 102 be physically disturbed or displaced. Alternatively, the snap-fit arrangement can allow for body 102 to be securely attached to suspension mechanism 104, but able to be displaced. For example, attachment element 110 and body 102 can utilize a grooved arrangement of attachment element snap-fit structures 158 and body snap-fit structures 160 to allow body 102 to slide in relation to attachment element 110, while maintaining attachment between the two structures. This would allow a user to adjust the point of attachment of attachment element 110 to body 102.

The snap-fit attachment can be configured such that body 102 is securely attached to suspension mechanism 104 and will not become unattached through the weight of body 102 or unintentional displacement of body 102, but can become unattached due to intentionally applied force, for example manual operation force, applied directly to the snap fit connection. This arrangement allows for body 102 to be spatially re-adjusted in relation to suspension mechanism 104, providing more freedom of arrangement in designing lighting arrangements, especially in limited space.

In some embodiments, attachment element 110 can be configured to contain a power supply and/or other electrical components. This configuration can be utilized alternatively or in addition to embodiments wherein power supply cover 108 contains a power supply and/or other electrical components. Various electrical components can be arranged internally to power supply cover 108 and/or attachment element 110. For example, in embodiments where an LED lighting element 106 is to be utilized, current and voltage converters can be included in order to condition the input voltage and current to drive the appropriate design voltage and current of the LED circuit.

It is understood that while attachment arrangements utilizing attachment element 110 and body 102 are discussed above, other attachment arrangements are also possible. For example, in embodiments wherein suspension mechanism 104 does not comprise attachment element 110, body 102 can attach directly to suspension mechanism 104. In these embodiments, suspension mechanism 104 can comprise snap-fit structures or can be otherwise attached to body 102 as discussed above. Other attachment mechanisms can also be used including but not limited to, snaps, screws, hooks, brackets, rivets, Velcro, or bonding agents such as glue.

Considering now the body portion of lighting fixtures according to the present disclosure, FIG. 3 depicts a front perspective view of one embodiment of lighting element body 200 according to the present disclosure. Lighting element body 200 is similar to lighting element body 102 described above, wherein the corresponding disclosure above is incorporated into this embodiment such that like features share the same reference numbers. Body 102 comprises lens 112, body snap-fit structures 160, and lighting element receiving structure 202. FIG. 3 is shown with the "lens-portion" in an upward facing orientation in contrast to FIGS. 1 and 2 above which depict the "lens-portion" in a downward facing orientation.

The entirety of body 102, or one or more dedicated surfaces, can serve as the lens portion 112. Lens 112 can protect a received lighting element and can diffuse, magnify, or otherwise alter light output. Lens 112 should be made from a material that facilitates the transmittance of light. Lens 112 can be made of the same material as the rest of body 102 or can be made from a different material and integrated into body 102, for example via a co-extrusion process. Lens 112 can be clear, transparent or translucent, or can comprise additional structures and materials for altering the color of emitted light, with some embodiments comprising wavelength altering materials such as phosphors. In other embodiments, lens 112 can comprise light scattering particles, and the lens 112 can be structured or patterned to increase light extraction. In other embodiments, light altering properties, such as diffusive properties, can be imparted to lens 112, for example, by physically roughening the surface of lens 112, for example, via a machining process.

As discussed above, body snap-fit structures 160 can be configured to interact or mate with corresponding structures on an attachment element or on the suspension mechanism itself. FIG. 3 shows an embodiment wherein body snap-fit structures 160 comprise an accepting space 204 configured to receive a "hook-like" shape. A corresponding "hook-like" shape on an attachment element can be placed within accepting space 204 where it will become locked in place by one or more gripping edges 206 (two shown).

Applying force, such as manual force, to gripping edges 206 can allow a user to remove an attached attachment element or suspension mechanism from body 102 to allow for efficient cleaning and maintenance of lighting fixture 200. Furthermore, a user could then reattach the attachment element or suspension mechanism to another portion of body 102 to change the appearance of lighting fixture 200 or to accommodate for limited space. This allows for an adjustable mechanical suspension support connection between the attachment element/suspension mechanism and body 102.

FIG. 3 further depicts lighting element receiving structures 202, which are arranged to receive at least one lighting element. Lighting element receiving structures 202 can comprise a variety of shapes and configurations that allow or facilitate the receiving and incorporation of a lighting element into lighting fixture 200. Various shapes and structures can be utilized as lighting element receiving structures 202 and can be integrated into the body as shown or be separately attached to the body. Example lighting element receiving structures 202 include wedge, fins or grooved structures. In the embodiment shown in FIG. 3, lighting element receiving structures 202 have a similar structure to gripping edges 206, and can likewise be manually adjusted to remove a secured structure, in this case, a lighting element.

One or more portions of lighting element receiving structures 202 can be configured to be reflective surfaces 208. By forming reflective surfaces 208, the light extraction efficiency of lighting fixture 200 can be increased. Reflective surfaces 208 can be made reflective in various ways, including but not limited to treating them with a reflective film or chemical coating, by plating them with a reflective material or by selecting a reflective material for their composition. In some embodiments, reflective surfaces 208 are made of a material that is reflective white.

In some embodiments, the housing has an integrated transmissive portion and a reflective portion, with the transmissive portion and reflective portions formed together as one piece during manufacturing. In some embodiments, the upper portion or lens portion 112 can comprise the transmissive portion and can be transmissive of the light emitted from the lighting element. The lower portion can comprise the reflective portion and can be reflective to the light from the lighting element. In the embodiment shown, the transmissive portion begins generally at the portion that is above the reflective surfaces 208, while the reflective surfaces 208 and anything below comprise a reflective material.

The transmissive portion can comprise any of the materials described herein and can be formed integral to the reflective portion by various processes such as co-extrusion or injection molding. The reflective portion can be formed of any materials described herein such as plastics, polymers and PC, with some of these materials being white. In other embodiments surfaces of the reflective portion can be coated with, or comprise, other reflective materials such as specular reflective or diffusing reflective materials. Forming integral lens and body portions allows for quick and inexpensive manufacturing of the body 102, and results in a robust and rigid housing structure. It is understood that other features of the light engine can be formed integral to the light engine housing through the co-extrusion process.

FIG. 3 show only one embodiment of body 102 that can have transmissive and reflective portions. In other embodiments, the transmissive portion can be smaller, and may only comprise the upper surface of the body 102, with the other portions comprising a reflective material. In other embodiments, the transmissive portion may even be smaller and can comprise a strip down the middle of the body's top surface. Still other embodiments can have different shapes and designs for the transmissive portion.

Many different lighting elements can be utilized with lighting fixtures incorporating features of the present invention. In some embodiments, LED arrays or LED-based light engines can be used. For example, FIG. 4 is a partial top perspective view of an example lighting element that can be utilized with fixtures according to the present disclosure. FIG. 4 depicts a linear lighting element 250 comprising a reflective body 252, one or more LEDs 254, a printed circuit board ("PCB") 256 (on the opposite surface of body 252, shown in more detail in FIG. 5 below) and electrical connections 258. Body 252 can be made from a similar material to fixture body 102 discussed above, or made from another material know in the art that is suitable for mounting a plurality or array of LEDs. Multiple instances of lighting element 250 can be attached together by various means including chemical adhesives, soldering or mechanical attachment structures such as attachment clips 260. Electrical connections 258 can connect directly to the PCB 256.

Many different LEDs 254 can be utilized with lighting elements according to the present disclosure. For example, LEDs 254 can comprise highly efficient LED packages that are capable of operating at lower drive signals than many conventionally used LEDs. Since the current needed to drive such highly efficient LEDs can be lower, the power in each LED can also be lower. Multiple LEDs can be used to achieve the same output as fewer LEDs with a higher current. By using more LEDs the necessary heat dissipation area can be smaller. Examples of such highly efficient LEDs are described in detail in U.S. patent application Ser. Nos. 13/649,052, 13/649,067 and 13/770,389, all of which are assigned to Cree, Inc., which are hereby incorporated herein in their entirety by reference, including the drawings, charts, schematics, diagrams and related written description.

One way in which such highly efficient LEDs can operate at lower drive signals than convention LEDs is that the highly efficient LED packages have a greater LED area per package footprint, which can allow for higher packing density. In many applications, this allows for driving the same area of LED packages with a lower drive signal to achieve the same emission intensity. This can result in greater emission efficiency. In other embodiments, the same drive current can be used, and the LED packages that can be utilized with the present invention can be used to generate higher emission intensity. These embodiments provide the flexibility of providing LED package emission with high luminous flux, or with lower luminous flux at greater efficiency.

Considering now the arrangement of the PCB and the attachment of electrical connections, FIG. 5 displays a partial top perspective view (with the "lens-side" in a downward facing position) of one embodiment of a lighting element configuration that can be utilized with the present disclosure, wherein the corresponding disclosure above is incorporated into this embodiment such that like features share the same reference numbers. FIG. 5 depicts lighting fixture 300, similar to lighting fixture 150 above. Lighting fixture 300 comprises body 102, which is arranged to receive lighting element 302, which is similar to lighting element 250 above, but is shown from the opposite side.

Like lighting element 250 shown above in FIG. 4, lighting element 302 comprises a body (not shown, it is on the opposite surface), one or more LEDs (not shown, they are on the opposite surface), a PCB 256 and one or more electrical connections 258. Electrical connections 258 can attach directly to PCB 256 and provide power to lighting element 302. Since PCBs can be designed such that an electrical connection can be provided at different locations, linear lighting fixtures can be designed such that electrical connections 258 are attached to linear lighting elements virtually anywhere along their position in the linear fixture, rather than only at the distal ends. Electrical connections 258 can be provided to PCB 256 by way of a suspension mechanism as will be discussed in further detail below.

While the present disclosure discusses the use of a PCB, with adjustments to body 102 and/or the use of highly efficient LEDs as discussed above, it is possible to utilize a conductive element structure instead of a PCB. Such a conductive element structure can include, for example, copper wire, conductive rails, magnet wire, non-conductive materials selectively coated with conductive materials, flattened braided wire and flex circuits on polyamide film. These and other substitutes for a traditional PCB are discussed in detail in U.S. patent application Ser. No. 13/782,820 to Mark Dixon, et al., entitled Integrated Linear Light Engine, which has been incorporated in its entirety by reference above into the present application.

In considering the arrangement of the light fixture body after it has received a lighting element, FIG. 6 shows a front perspective view of one embodiment of a lighting fixture 350, similar to lighting fixture 200 above, wherein the corresponding disclosure above is incorporated into this embodiment such that like features share the same reference numbers. Like FIG. 3 above, FIG. 6 is shown with the "lens-end" in an upward position in contrast to FIGS. 1 and 2 above which depict the "lens-end" in a downward position. Lighting fixture 350 comprises body 102, which comprises lens 112, body snap-fit structures 160, lighting element receiving structure 202, accepting space 204, gripping edges 206 and reflective surfaces 208.

Lighting fixture 350 is arranged to accept lighting element 352, similar to lighting element 250 above, wherein the corresponding disclosure above is incorporated into this embodiment such that like features share the same reference numbers. Lighting element 352 comprises a body 252, one or more LEDs 254, a PCB (on the opposite surface of body 252) 256 and electrical connections 258. FIG. 6 demonstrates the spatial arrangement of a lighting element 352 with the fixture body 102. Lighting element 352 is received by body 102 and secured in place by lighting element receiving structure 202. LEDs 254 face toward lens portion 112, with the PCB 256 facing the opposite direction (toward the end of body 102 that will be facing an attachment element and/or suspension mechanism) and being in electrical contact with electrical connections 258.

Some embodiments utilize different attachment elements and can allow further fixture adjustability through the employment of pivotal connections. FIG. 7 is partial side perspective view of another embodiment of a lighting fixture according to the present disclosure. FIG. 7 shows lighting fixture 400, similar to lighting fixture 100, wherein the corresponding disclosure above is incorporated into this embodiment such that like features share the same reference numbers. Lighting fixture 400 comprises body 102, suspension mechanism 104, lens 112, and body snap-fit structures 160. Body 102 is configured to receive a lighting element 402, similar to lighting element 250 above, wherein the corresponding disclosure above is incorporated into this embodiment such that like features share the same reference numbers. Of the components of lighting element 402, only PCB 256 can be seen in FIG. 7, the remaining lighting element components being concealed by body 102.

Lighting fixture 400 further comprises attachment element 404, which differs from attachment element 110 above in its shape and its attachment to suspension mechanism 104. Attachment element 404 has an arch-like structure with a rounded top surface rather than the more angular structure depicted in FIG. 1. However, like attachment element 110 above, attachment element 404 and has attachment element snap-fit structures 406 which can interact or mate with body snap fit structures 160, fixing body 102 in place.

Attachment element 404 is connected to suspension mechanism 104 by a pivotal connection 408. Pivotal connection 408 can be achieved through various grove or hinge structures. In the embodiment depicted in FIG. 7, pivotal connection 408 is achieved through the connection of a grooved bolt 410 (which can be permanently attached to suspension mechanism 104) and a corresponding attachment opening 412 (formed in attachment element 404) that mates with grooved bolt 410. The inner surface of attachment opening 412 can slide and adjust position with the grooved portion of grooved bolt 410. This arrangement allows attachment element 104, and therefore an attached fixture body 102, to move pivotally about an axis formed by suspension mechanism 104.

Pivotal connection 408 can be strong enough such that when the position of fixture body 102 is adjusted in relation to suspension mechanism 104, the position will remain constant and will not change due unintentional displacement forces on lighting fixture 400. For example, the weight of body 102 will not affect pivotal connection 408, however an intentional direct manual force will. Alternatively or in addition to increasing the strength of pivotal connection 408, unintentional displacement of body 102 can be prevented by installing a locking mechanism that can be toggled "on" or "off" and will prevent pivotal movement while toggled on. Such locking mechanisms are known in the art.

The suspension mechanism and attachment element can further arrange, provide or conceal electrical connections. FIG. 8 is a partial unassembled view of one embodiment of a lighting fixture 450, similar to lighting fixture 400 above, which is configured to accept a lighting element 452, similar to lighting element 402 above, wherein the corresponding disclosure above is incorporated into this embodiment such that like features share the same reference numbers. Lighting fixture 450 comprises body 102, suspension mechanism 104, lens 112 and attachment element 404, which comprises attachment element snap-fit structures 406 and pivotal connection 408. Of the components of lighting element 452, only PCB 256 and electrical connections 258 can be seen in FIG. 8, the remaining lighting element components being concealed by body 102.

FIG. 8 shows how electrical connections 258 can be provided to lighting element 452 by suspension mechanism 104, which arranges and conceals electrical connections 258. In the embodiment shown in FIG. 8, suspension mechanism 104 is hollow and electrical connections 258 are ran from a power supply through suspension mechanism 104, through opening 454, and then connected to PCB 258, providing electrical power to lighting element 452. In some embodiments, the interior surfaces of suspension mechanism 104 have additional structural elements such as wings or gripping structures that can further be used to organize and direct electrical connections 258 to lighting element 452.

Suspension mechanism 104 can also act as a storage space for additional length of power cords and wires, in this way, a greater length of wire can be released from suspension mechanism 104, if body 102 is detached from attachment element 404, giving attachment element 404 a greater distance it can travel and reattach to a different point on body 102 without substantially straining or damaging electrical connections 258. This provides greater freedom in designing mechanical suspension support for fixtures. Additional length of electrical connection components can also be stored within the inner surface of a mounting surface, for example, within or near a junction box within a ceiling.

Endcaps can be provided at the distal ends of light fixtures according to the present disclosure. FIG. 9 is partial side perspective view of one embodiment of a lighting fixture 500, similar to lighting fixture 100 above, wherein the corresponding disclosure above is incorporated into this embodiment such that like features share the same reference numbers. Lighting fixture 500 comprises body 102, having at least one distal end 114. FIG. 9 illustrates that an optional endcap 502 can be utilized with this invention. Endcap 502 can interface with a distal end 114 of body 102 and provide additional protection and enclosure to components internal to body 102, such as a lighting element. The additional protection provided by endcap 502 is especially useful in embodiments of the present invention wherein there are no electrical or mechanical connections present at the distal ends 114 of body 102.

End caps are only one type of end cap that can be used and is only one of the many structures that can be included at the distal ends 114 of the body 102. In other embodiments the distal end can have connection or coupling structures that can allow for the interconnection of a plurality of bodies. These can include electrical connections between the bodies to carry the emitter drive signal, and covers or connectors to hold the bodies to together and to cover the junction between the bodies. Different covers or connectors could hold the bodies in an end-to-end linear configuration, or can hold the bodies at an angle to one another, with some angled configurations described below.

Additional pivotal and/or rotational connection can be utilized with fixtures according to the present disclosure. FIG. 10 is partial side perspective view of one embodiment of a lighting fixture 600 according to the present disclosure. Lighting fixture 600 comprises a power supply cover 602 and a suspension mechanism 604 which is arranged to provide an electrical connection 606 to at least one lighting element. Power supply cover 602 has an open top surface and, in this particular embodiment, does not completely contain a power supply or other electrical features. In this embodiment, power supply cover 602 would be attached to a mounting surface in which there is a junction box. A power supply or other electrical components can be at least partially installed into the junction box and connected to electrical connections 606.

Lighting fixture 600 can also comprise one or more additional pivotal connections. A pivotal connection 608 can form a pivotal connection between the suspension mechanism and the power supply cover or even a mounting surface itself, allowing a user to adjust the position of the suspension mechanism 604 in relation to the power supply cover 602 or a mounting surface. Pivotal connections can be achieved through various means such as grove or hinge structures. In the embodiment shown in FIG. 10, pivotal connection 608 is achieved through use of a hinge structure where suspension mechanism 604 pivots about a hinge connecting power supply cover 602 with suspension mechanism 604, which in turn allows motion of a fixture body connected to suspension mechanism 604.

Suspension mechanism 604 can further comprise a rotational connection 610, which allows suspension mechanism 604, and thus an attached fixture body, to be rotated about the central axis of suspension mechanism 604. Such rotational connections can be achieved through various means including utilizing a screw-like mechanism 612 to connect multiple portions of suspension mechanism 604. The screw-like mechanism 612 can be effectively concealed in the interior surface of suspension mechanism 604.

Figure 11:
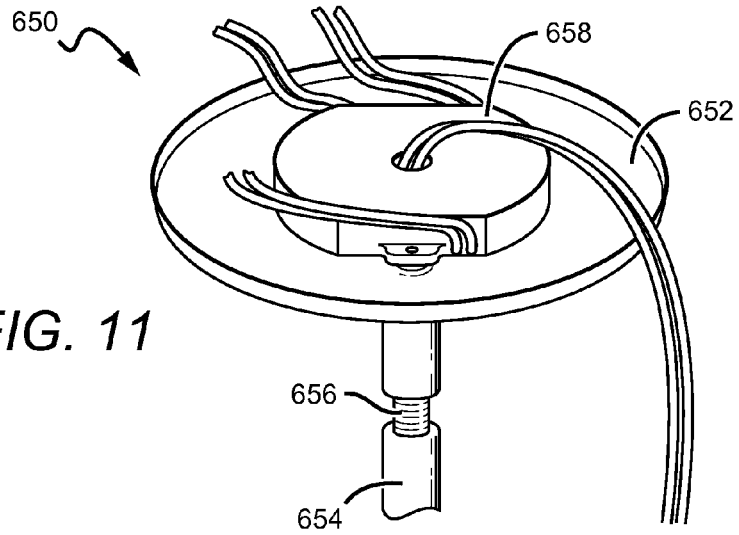
FIG. 11 is partial top perspective view of one embodiment of a lighting fixture according to the present disclosure.

The power supply cover can also at least partially house the power supply. FIG. 11 is partial top perspective view of one embodiment of a lighting fixture 650 according to the present disclosure. Lighting fixture 650 comprises a power supply cover 652 and a suspension mechanism 654 with a rotational connection 656. Power supply cover 652 is arranged to at least partially contain at least one power supply 658. In some embodiments power supply 658 is contained entirely in power supply cover 652. In some embodiments, power supply 658 is partially contained in a junction box within a mounting surface. Power supply 658 can contain electrical components necessary to adjust electricity from the junction box to the appropriate drive current and voltage for an LED circuit on the PCB.

Figure 12:
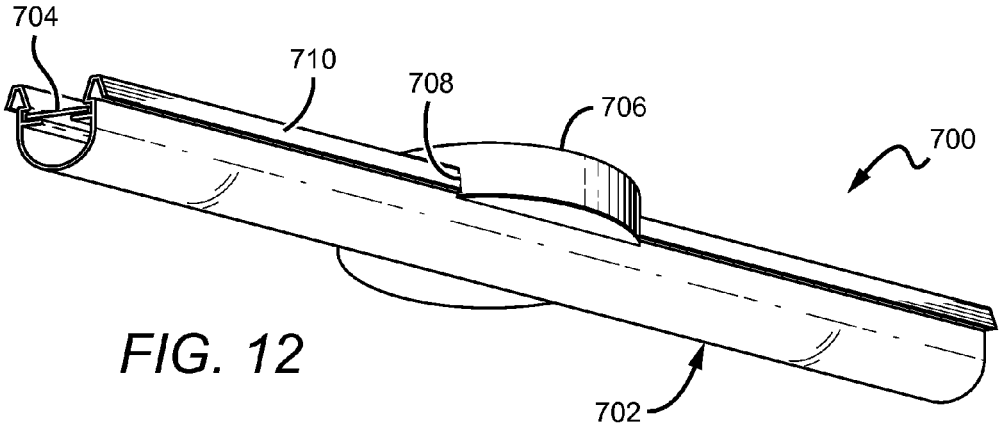
FIG. 12 is a side perspective view of one embodiment of a lighting fixture according to the present disclosure.

In some embodiments, the power supply cover itself can function as the suspension mechanism. FIG. 12 demonstrates such an embodiment is a side perspective view of a lighting fixture 750. Lighting fixture 750 comprises body 702, configured to receive lighting element 704 and power supply cover 706. Power supply cover 706 functions as a suspension mechanism fixing body 702 in place at least some distance away from a mounting surface (albeit typically a shorter distance than if a separate suspension mechanism were utilized).

Power supply cover 706 can incorporate features of other presently disclosed power supply covers, suspension mechanisms and attachment elements discussed above and the corresponding description is incorporated into this embodiment. Power supply cover 706 can further comprise an attachment element such as those discussed above. In the embodiment shown in FIG. 12, power supply cover 706 comprises at least one cover snap-fit structure 708 which can interact or mate with a corresponding body snap-fit cover 710 as discussed above.

Figure 13:
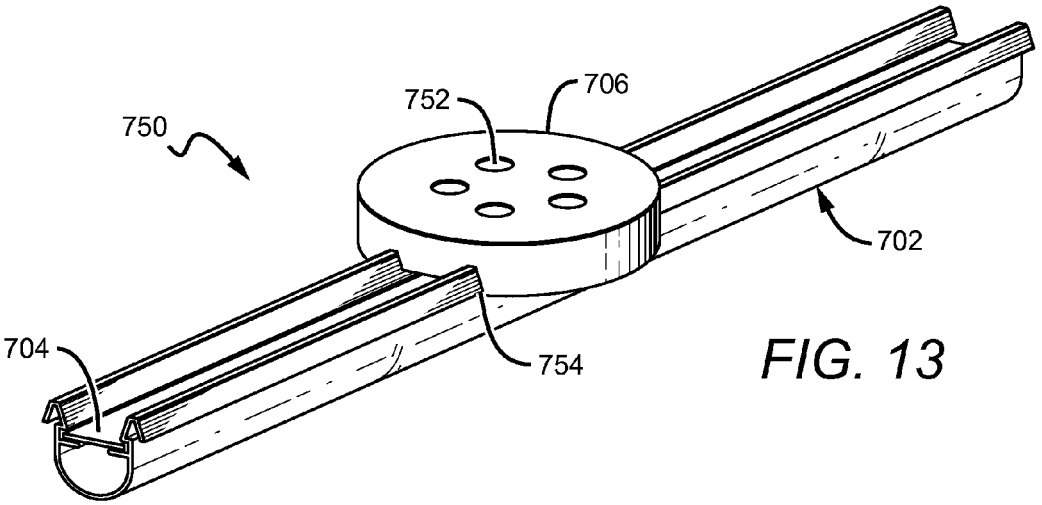
FIG. 13 is a side perspective view of one embodiment of a lighting fixture according to the present disclosure.

To further illustrate embodiments wherein the power supply cover, suspension mechanism and attachment element are all integrated into a single structure, FIG. 13 demonstrates a different side perspective view of a lighting fixture 750, similar to lighting fixture 700 above, wherein the corresponding disclosure above is incorporated into this embodiment such that like features share the same reference numbers. Lighting fixture 750 comprises body 702, configured to receive lighting element 704 and power supply cover 706.

FIG. 13 shows the top surface 752 of supply cover 706 which can be open or contain holes or other open portions as embodiments discussed above. Power supply cover 752 can be attached to body 702 such that the attachment connection between these two structures 754 allows for body 702 to slide in relation to power supply cover 706. This can be accomplished by various means, such as a grooved connection. Like other embodiments above, the connection point 754 between power supply cover 706 and body 702 can be self-connecting and can be configured such that manual force applied to connection point 754 can allow body 702 to be removed so that body 102 can be later connected to supply cover 706 at a different point.

Other embodiments can be configured so that the body can be connected to either the power supply cover as shown in FIGS. 12 and 13, or connected to a suspension mechanism as shown in FIGS. 1 and 2, and discussed above. In those embodiments connected to the power supply cover the suspension mechanism is not used and the body can be snapped in place to the cover. In those embodiments using the suspension mechanism, the suspension mechanism can be attached to the power supply cover and the body can be snap fit to the suspension mechanism. The arrangement allows for flexibility in the manufacturing and use of the light fixtures according to the present invention, and allows for users to be provided with a single fixture than can be installed in both ways.

Figure 14:
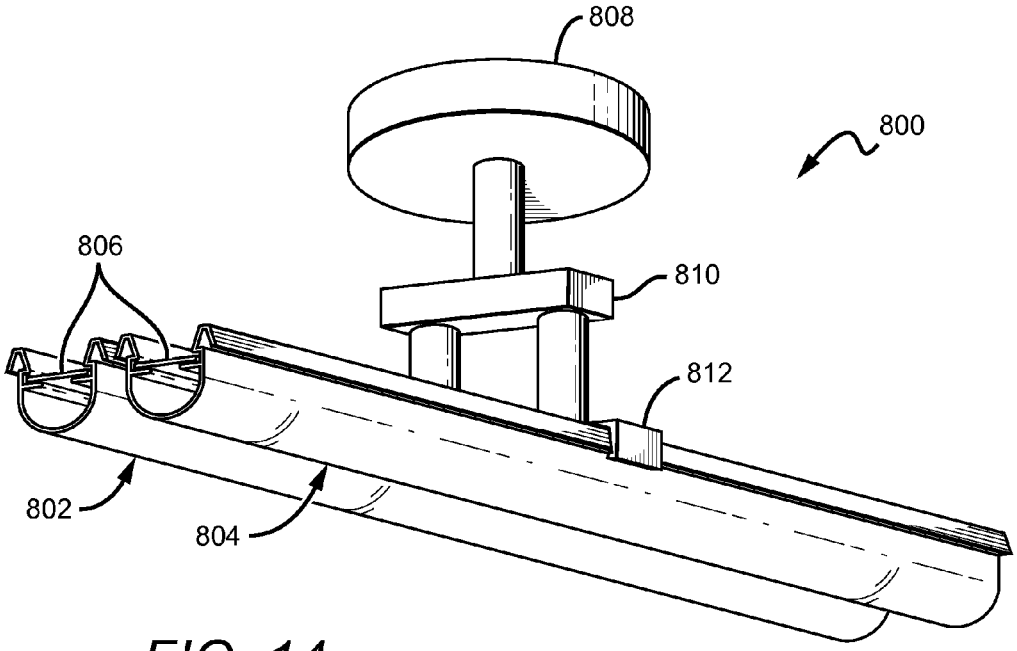
FIG. 14 is a side perspective view of one embodiment of a lighting fixture according to the present disclosure.
Figure 15:
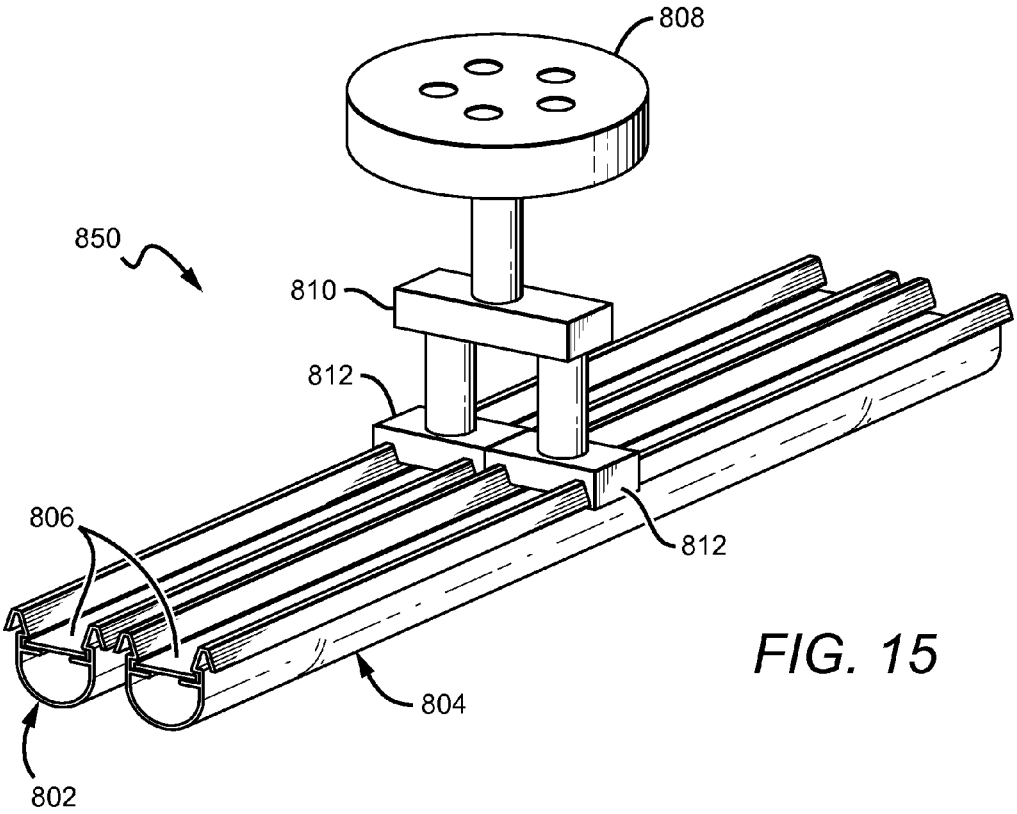
FIG. 15 is side perspective view of one embodiment of a lighting fixture according to the present disclosure.

Many different arrangements are possible utilizing fixtures according to the present disclosure and multiple components such as fixture bodies and suspension mechanisms can be utilized in a single fixture. FIGS. 14 and 15 show two different side perspective views of lighting fixtures 800 and 850 respectively. Each of these lighting fixtures comprises at least two bodies 802, 804 arranged to receive at least one lighting element 806, a power supply cover 806, a suspension mechanism 810 that branches off to support and provide an electrical connection to the lighting element, and attachment elements 812 that attach bodies 802, 804 to suspension mechanism 810.

One or more power supplies and/or electrical connections can be arranged such that lighting elements 806 at each body 802, 804 produce different lighting characteristics (i.e. intensity, flickering, etc.) or power supplies and connections can be arranged such that the lighting elements 806 at each body 802, 804 produce the same or similar lighting characteristics.

Multiple bodies can also be utilized in embodiments wherein the power supply cover is also the suspension mechanism (such as the embodiments discussed above with reference to FIGS. 12 and 13. FIGS. 16 and 17 show different side perspective views of lighting fixtures 900 and 950 respectively. Each of these fixtures comprise at least two bodies 902, 904, configured to accept at least one lighting element 906, and a power supply cover 908. Supply cover 908 can contain one or more power supplies and/or additional electrical components and can be configured to adjust electrical voltage and current to lighting elements 906 received by different bodies 902, 904 such their various lighting characteristics are different or uniform depending on the desired lighting output.

Different lighting fixtures according to the present invention can be arranged in many different ways beyond those described above. In some embodiments, the lighting bodies can be arranged in different ways, there can be different numbers of lighting bodies interconnected in different ways, and additional features can be included in the lighting fixtures to accommodate the different lighting bodies. By way of example, the lighting bodies in the embodiments above are arranged in the fixtures such that their primary illumination is directed down in a direction opposite the power supply cover. In other embodiments, the lighting bodies can be arranged such that their primary illumination is directed up toward the power supply cover to illuminate the ceiling around the lighting fixtures. This light can then be reflected off the ceiling to illuminate the room below the ceiling.

FIG. 18 shows another embodiment of a lighting fixture 1000 according to the present invention, comprising a suspension mechanism 1004, a plurality of lighting bodies 1002, a power supply cover 1008 that can be the similar to corresponding elements described in the embodiments above and can be made of the same materials. In this embodiment, the lighting fixture 1000 is arranged in a fan layout, with multiple lighting bodies 1002 radiating out from a central hub 1010. The electrical signal to drive the lighting bodies 1002 can be transmitted to the lighting bodies 1002 through the suspension mechanism 1004 and the hub 1010. The lighting fixture as shown comprises four lighting bodies 1006 (one hidden behind the hub 1010), but different fan layout embodiments can have different numbers of lighting bodies of different lengths. In still other lighting fixtures, two lighting bodies can be used that are crossed to form the lighting fixtures fan layout, with the crossed bodies connected to a suspension mechanism.

Figure 19:
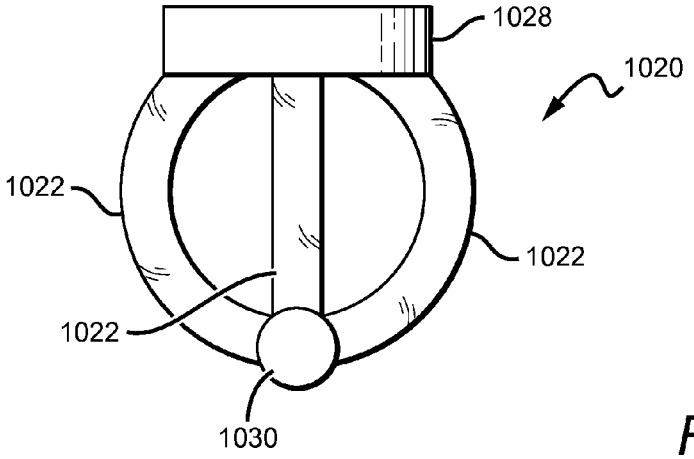
FIG. 19 is a side view of another embodiment of a lighting fixture according to the present invention.

The embodiments above have also been described with reference to straight lighting bodies, but other embodiments can have one or more bent lighting bodies. FIG. 19 shows still another embodiment of a lighting fixture 1020 according to the present invention. This embodiment comprises a plurality of lighting bodies 1022 and a power supply cover 1028. The lighting fixture 1020 comprises four lighting bodies 1022 that are bent in an arc and run between the power supply cover 1028 and a placeholder 1030 that can serve to hold the bottom ends of the light bodies 1022. This embodiment can also comprise a suspension mechanism (not shown) that can run between the power supply cover 1028 to the placeholder 1030. Other embodiments can be provides without a placeholder or without a suspension mechanism, with an electrical signal applied to each lighting element directly through the power supply cover 1028. Still other embodiments can have different numbers of lighting elements bent into different shapes.

Figure 20:
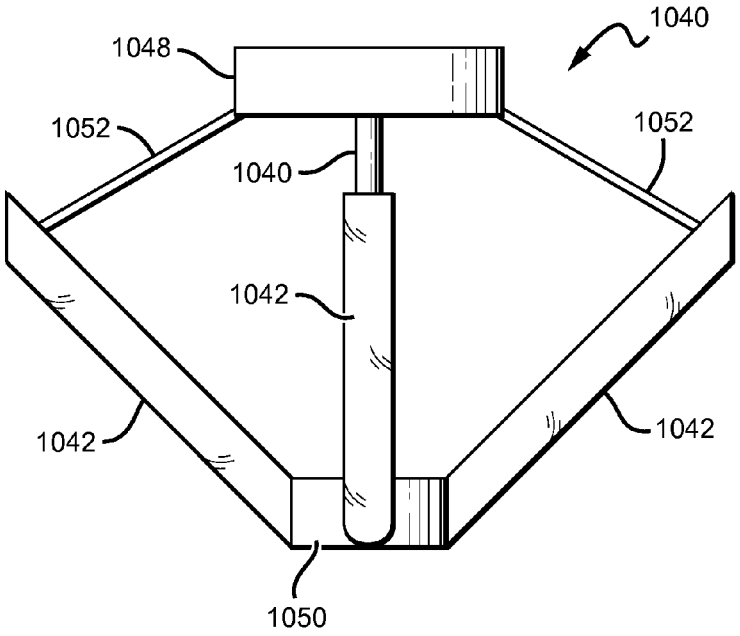
FIG. 20 is a side view of another embodiment of a lighting fixture according to the present invention.

FIG. 20 shows still other embodiment of a lighting fixture 1040 according to the present invention that is similar to the fan embodiment above and is also arranged in a fan layout. The lighting fixture comprises a suspension mechanism 1044, lighting bodies 1042, power supply cover 1048 and a central hub 1050. In this embodiment, however, the lighting elements are angled up moving out from the hub 1050. Holding wires 1052 can be included running between the power supply cover 1048 and each of the lighting bodies 1042, although in other embodiments they may not be necessary. The lighting fixture 1040 has four lighting bodies 1042 each arranged at the same angle, but in other embodiments a different number of lighting bodies can be included, and in still other embodiments one or more of the lighting bodies can be arranged at different angles.

Figure 21:
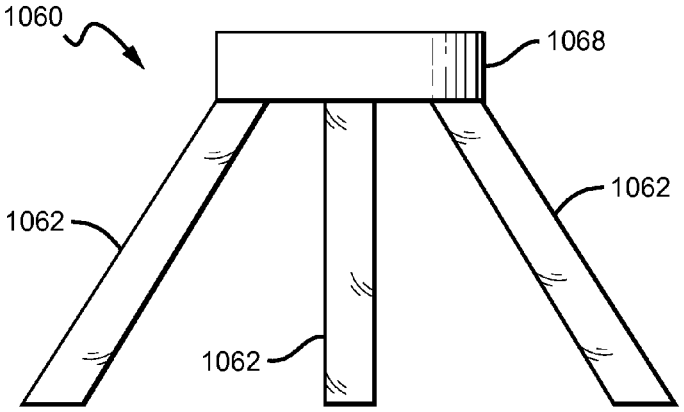
FIG. 21 is a side view of another embodiment of a lighting fixture according to the present invention.

FIG. 21 shows another embodiment of a lighting fixture 1060 comprising lighting bodies 1062 extending out at an angle moving away from the power supply cover 1068. The light fixture 1060 is shown with four lighting bodies 1062 at the same angle, but similar to the light fixture 1040, different numbers of lighting bodies can be used and the lighting fixtures can be at different angles.

Figure 22:
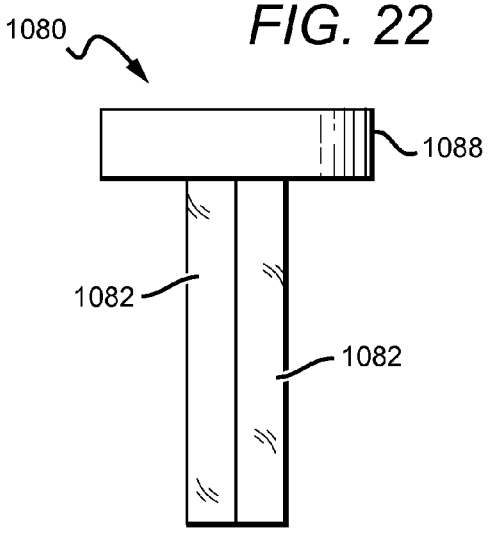
FIG. 22 is a side view of another embodiment of a lighting fixture according to the present invention.

FIG. 22 shows still another embodiment of a lighting fixture 1080 according to the present with lighting bodies 1082 extending directly down from the power supply cover 1088. This embodiment comprises two lighting bodies 1082 arranged back-to-back to provide a light emitting rod emitting light in opposing direction. To provide a more omnidirectional emission, the lighting fixture 1080 can comprise more than two lighting bodies generally arranged back to back and emitting out. In other embodiments, the lighting bodies can be spread on the power supply cover and can be oriented to provide the desired emission pattern.

Figure 23:
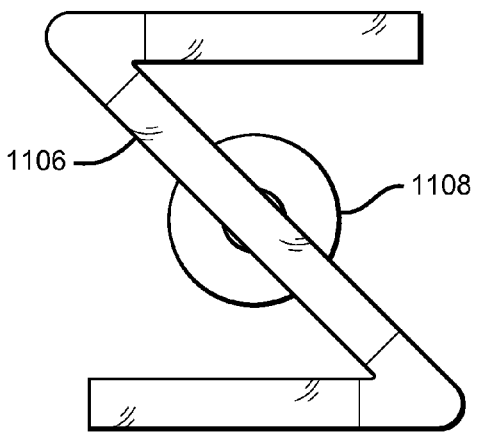
FIG. 23 is a bottom view of another embodiment of a lighting fixture according to the present invention.
Figure 24:
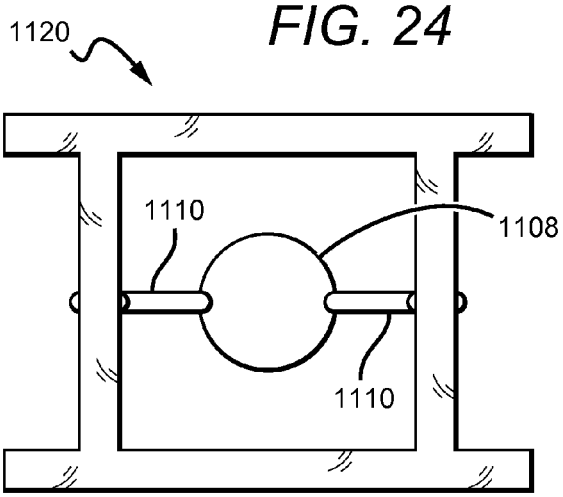
FIG. 24 is a bottom view of another embodiment of a lighting fixture according to the present invention.

Different lighting fixture embodiments can have lighting bodies that are shaped or coupled in many different ways to form different shapes and designs. FIG. 23 is bottom view of another embodiment of a lighting fixture 1100 according to the present invention comprising a shaped lighting body 1106 suspended from a power supply cover 1108 by a suspension mechanism (not shown), with the lighting body provided in a Z-shape. In some embodiments, the lighting body can be formed in a Z-shape, while in other embodiments a plurality of lighting bodies can be coupled in a Z-shape. This is only one of the many shapes that the different embodiments can take, with FIG. 24 showing another embodiment of a lighting fixture 1120 in having a square shape, FIG. 25 showing a lighting fixture 1130 with an I-shape, and FIG. 26 showing a lighting fixture 1140 with a fence shape. Each can be attached to a power supply cover 1108 by one or more suspension mechanisms (shown only in FIG. 24 as 1110). These embodiments can also be formed in these different shapes or can comprise a plurality of coupled lighting fixtures. The lighting fixtures can take other shapes such as triangle, rectangle, pentagon, or any other polygon shape. Different embodiments can also be provided in three-dimensional arrangements but not limited to pyramids or cubes.

FIG. 27 is a bottom view of still another embodiment of a lighting fixture 1160 according to the present invention that comprises a right angle lighting body 1166. This embodiment is particularly applicable for mounting at the corner of a ceiling, and the power supply cover 1168 can be mounted in the corner a well. The lighting bodies 1166 can be mounted to the power supply cover 1168 by a suspension mechanism (not shown) or can be mounted directly to the power supply cover 1168.

The lighting elements described above can also take many different shapes and can have light sources arranged in different ways. FIGS. 28 through 30 show another embodiment of a lighting fixture 1200 according to the present invention have a lighting body 1202 that is bow shaped. The lighting fixture can be mounted to a power supply cover 1206 by a suspension mechanism 1208. The body 1202 comprises a central solid portion 1210 and edge solid portions 1212 that do not transmit light, and two lens portions 1214 that transmit light. The body 1202 can comprise one or more cables 1215 between the edges of the body 1202 to help hold the body 1202 in its bow shape, but in other embodiment cables may not be necessary. The lighting fixture 1200 further comprises two elongated lighting elements 1216, each having an linear array of LEDs 1218 and each mounted to the central solid portion 1210. The lighting elements 1216 can be mounted in many different ways, with the embodiment shown having lighting elements arranged with the LEDs emitting up toward the power supply cover 1206.

Referring now to FIG. 30, light from the lighting elements 1216 is directed up toward, and at least partially reflects off the ceiling. A portion of the reflected light passes through the lens portions 1214 and light striking the solid portions 1210, 1212 is blocked. Light primarily emits through the lens portions, while the solid portion 1210 can visually conceal many of the elements of lighting fixture. This allows for the lighting fixture 1200 to provide a visual appealing light emission pattern.

FIG. 31 shows another embodiment of lighting fixture 1240 according to the present invention that is similar to the lighting fixture 1200, but relies on direct emission through the lens portions 1214. The lighting fixture 1240 comprises a lighting element bracket 1242 that is mounted to the central solid portion 1210, with the bracket 1242 having lighting element channels 1244 to hold the lighting elements 1216 at an angle so that light primarily emits directly out of the lens portions 1214. The brackets remain hidden behind the solid portion 1210, with the lighting fixture also providing a visually appealing emission without relying on reflecting light from the ceiling.

Figure 33:
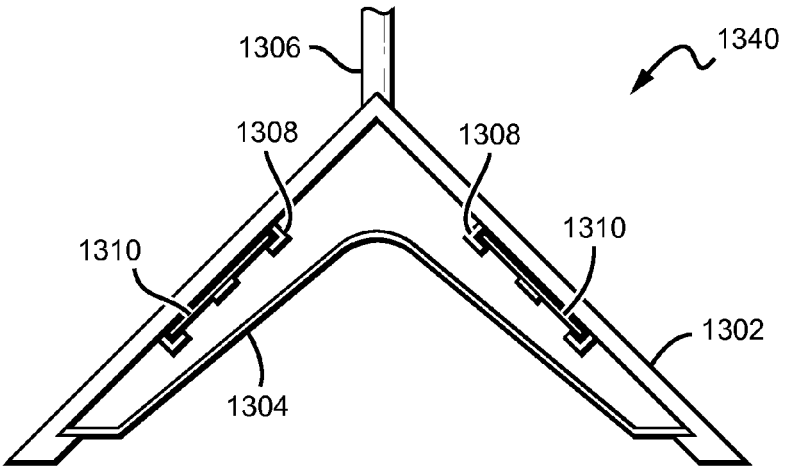
FIG. 33 is an end view of the lighting fixture shown in FIG. 32.
Figure 34:
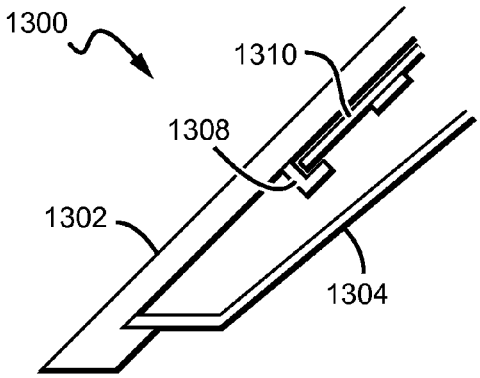
FIG. 34 is another end view of the lighting fixture shown in FIG. 32.

FIGS. 32 through 34 show still another embodiment of a lighting fixture 1300 that also relies on direct emission. The fixture comprises a lighting body 1302 with a V-shaped cross section and a V-shaped lens 1304. The body can be mounted to a power supply cover (not shown) by a suspension mechanism 1306. The inside surface of the body 1302 can have one or more lighting element channels 1308 to hold elongated lighting elements 1310 having LEDs emitting directly through the lens 1304. The lens 1304 can mix and/or disperse the LED light as it passes through, with the lens being made of any of the materials described above. The body and lens 1302, 1304 can be co-extruded, or can be separately formed and then snapped or bonded together.

Figure 35:
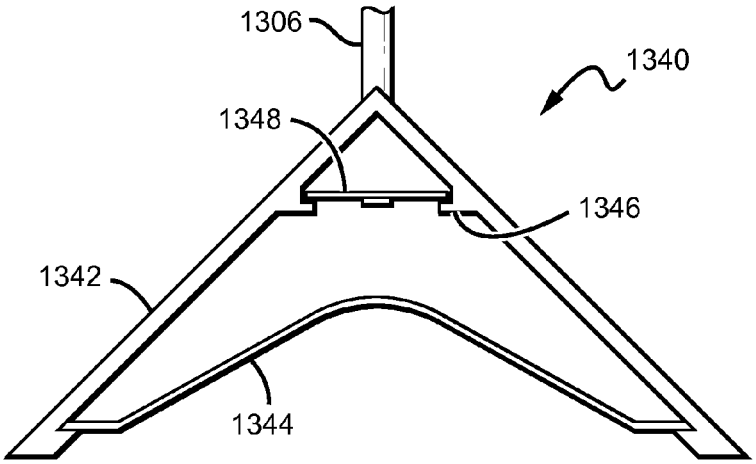
FIG. 35 is an end view of another embodiment of a lighting fixture according to the present invention.

In different embodiments the lighting element, body and lens can be arranged in different ways. FIG. 35 shows another embodiment of a lighting fixture 1340 having a body 1342 and lens 1344, with the body 1342 having a single lighting element channel 1346 in its upper portion. The channel holds a lighting element 1348 with its emitters emitting light down and through the lens 1344. The lens in this embodiment has a curved cross section, but is otherwise similar to the lens 1304 described above.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A lighting fixture, comprising:

a body comprising first and second linear grooved receiving structures collectively configured to receive and hold a linear lighting element, wherein said receiving structures comprise portions that are on opposite sides of said linear lighting element and comprise at least one reflective surface;

a suspension mechanism configured to provide an electrical connection from a power source to said lighting element, such that said lighting element is connected to said power source at a location other than one of the distal ends of said lighting element; and a power supply cover which is separate from said body.

2. The lighting fixture of claim 1, wherein said suspension mechanism fixes said body in place at a distance from a mounting surface.

3. The lighting fixture of claim 1, wherein said suspension mechanism is a power supply cover.

4. The lighting fixture of claim 1, further comprising a pivotal connection that allows the position of said body to be adjusted in relation to said suspension mechanism.

5. The lighting fixture of claim 1, further comprising a pivotal connection that allows the position of said suspension mechanism to be adjusted in relation to said body.

6. The lighting fixture of claim 1, further comprising a rotational connection, said rotational connection configured such that said body can rotate about the axis of said suspension mechanism.

7. The lighting fixture of claim 1, further comprising an attachment element.

8. The lighting fixture of claim 7, wherein said attachment element comprises a self-connecting configuration that cooperates with a corresponding structure on said body.

9. The lighting fixture of claim 7, wherein said attachment element allows for removal and replacement of said body.

10. The lighting fixture of claim 7, wherein said attachment element allows for removal and replacement of said body by hand.

11. The lighting fixture of claim 7, wherein said attachment element comprises a snap fit connection configured to interact with a corresponding structure on said body.

12. The lighting fixture of claim 1, further comprising at least one additional body.

13. A lighting fixture, comprising:

a body configured to receive at least one lighting element; and a suspension mechanism configured to attach to said body at multiple possible points along said body, wherein said body is configured to slide to adjust the point of attachment to said suspension mechanism, and wherein said suspension mechanism is configured to provide an electrical connection from a power supply to said lighting element.

14. The lighting fixture of claim 13, further comprising a power supply cover.

15. The lighting fixture of claim 13, wherein said suspension mechanism is configured to provide an electrical connection to said lighting element at a location other than at a distal end of said lighting element.

16. The lighting fixture of claim 13, wherein said suspension mechanism is a power supply cover.

17. The lighting fixture of claim 13, further comprising a pivotal connection that allows the position of said body to be adjusted in relation to said suspension mechanism.

18. The lighting fixture of claim 13, further comprising a pivotal connection that allows the position of said suspension mechanism to be adjusted in relation to said mounting surface.

19. The lighting fixture of claim 13, further comprising a rotational connection, said rotational connection configured such that said body can rotate about the axis of said suspension mechanism.

20. The lighting fixture of claim 13, further comprising an attachment element.

21. The lighting fixture of claim 20, wherein said attachment element is self-connecting.

22. The lighting fixture of claim 20, wherein said attachment element comprises a snap fit connection configured to interact with a corresponding structure on said body.

23. The lighting fixture of claim 13, wherein said lighting element receiving structure comprises at least one reflective surface.

24. The lighting fixture of claim 13, further comprising at least one additional body.

25. A lighting system, comprising:

a body comprising left and right linear grooved receiving structures;

a linear lighting element comprising one or more light sources on a first surface, said lighting element held by said left and right linear grooved receiving structures such that at least a portion of said first surface of said linear lighting element is on said receiving structures;

a power supply outside of said body; and a suspension mechanism attached to said body wherein said suspension mechanism is configured to provide an electrical connection to said lighting element, such that said lighting element is connected to said power supply at a location other than one or more distal ends of said lighting element.

26. The lighting system of claim 25, wherein said suspension mechanism is configured to fix said body in place a distance away from a mounting surface.

27. The lighting system of claim 25, further comprising a power supply cover.

28. The lighting system of claim 25, wherein said at least one suspension mechanism is a power supply cover.

29. The lighting system of claim 25, further comprising a pivotal connection that allows the position of said body to be adjusted in relation to said suspension mechanism.

30. The lighting system of claim 25, further comprising a pivotal connection that allows the position of said suspension mechanism to be adjusted in relation to a mounting surface.

31. The lighting system of claim 25, further comprising a rotational connection, said rotational connection configured such that said body can rotate about the axis of said suspension mechanism.

32. The lighting system of claim 25, further comprising an attachment element.

33. The lighting system of claim 32, wherein said attachment element comprises a snap fit connection configured to interact with a corresponding structure on said body.

34. The lighting system of claim 25, wherein said lighting element receiving structure comprises at least one reflective surface.

35. The lighting system of claim 25, further comprising at least one additional body.

36. A lighting fixture, comprising:

a linear lighting element comprising at least one light emitting diode (LED) on a first surface;

a body comprising first and second linear grooved receiving structures configured to receive said linear lighting element, wherein said receiving structures comprise portions that are on opposite sides of said linear lighting element, and a portion of said receiving structures is on said first surface of said linear lighting element; and a suspension mechanism configured to fix said body in place at least a distance away from a mounting surface;

a power supply that is outside of said body, wherein said power supply is electrically connected to said lighting element.

37. The lighting fixture of claim 36, wherein said power supply is electrically connected to said lighting element along or through said suspension mechanism.

38. The lighting fixture of claim 36, said wherein said suspension mechanism is configured to provide an electrical connection from said lighting element to power, such that said lighting element is unconnected to said power supply at one or more distal ends of said lighting element.

* * * * *